US008115463B2

(12) United States Patent
Wang

(10) Patent No.: US 8,115,463 B2
(45) Date of Patent: Feb. 14, 2012

(54) COMPENSATION OF LDO REGULATOR USING PARALLEL SIGNAL PATH WITH FRACTIONAL FREQUENCY RESPONSE

(75) Inventor: Jianbao Wang, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 749 days.

(21) Appl. No.: 12/229,665

(22) Filed: Aug. 26, 2008

(65) Prior Publication Data

US 2010/0052635 A1 Mar. 4, 2010

(51) Int. Cl.
*G05F 1/40* (2006.01)

(52) U.S. Cl. ..... 323/280; 323/273

(58) Field of Classification Search ..... 323/268, 323/269, 273, 280, 281
See application file for complete search history.

(56) References Cited

U.S. PATENT DOCUMENTS

| | | | | |
|---|---|---|---|---|
| 6,188,211 | B1 * | 2/2001 | Rincon-Mora et al. | 323/280 |
| 6,765,374 | B1 * | 7/2004 | Yang et al. | 323/280 |
| 6,861,827 | B1 * | 3/2005 | Yang et al. | 323/273 |
| 7,531,996 | B2 * | 5/2009 | Yang et al. | 323/282 |

OTHER PUBLICATIONS

"Fractal System as Represented by Singularity Function" by A. Charef, H. H. Sun, Y. Y. Tsao, and B Onaral, IEEE Transactions on Automatic Control, vol. 37, No. 9, pp. 1465-1470, Sep. 1992.
"Analog Integrated Circuit Design", by D. Johns and K. Martin, John Wiley & Sons, p. 241, 1997.

* cited by examiner

*Primary Examiner* — Matthew Nguyen
(74) *Attorney, Agent, or Firm* — William B. Kempler; Wade J. Brady, III; Frederick J. Telecky, Jr.

(57) ABSTRACT

A low drop out (LDO) voltage regulator (10) includes a pass transistor ($MP_{pass}$) having a source coupled by an output conductor (4) to a load and a drain coupled to an input voltage to be regulated. An error amplifier (2) has a first input coupled to a reference voltage, a second input connected to a feedback conductor (4A), and an output coupled to a gate of the pass transistor. A parallel path transistor ($MP_{pa}$) has a source coupled to the input voltage, a gate coupled to the output (3) of the error amplifier (2), and a drain coupled to the feedback conductor. A feedback resistor ($R_f$) is coupled between the feedback conductor and the output conductor.

18 Claims, 18 Drawing Sheets

COMPENSATION OF LDO REGULATOR USING PARALLEL SIGNAL PATH WITH FRACTIONAL FREQUENCY RESPONSE

BACKGROUND OF THE INVENTION

The present invention relates generally to low dropout (LDO) linear voltage regulators of the kind having P-channel pass transistors, i.e., PMOS LDO linear voltage regulators. The invention also relates more particularly to such LDO voltage regulators having very low quiescent current and good phase margin despite large variations in the load and the output capacitance.

Various approaches have been used to address the problems associated with providing such LDO voltage regulators having low quiescent current, as is desirable for battery-powered applications in order to extend battery operating life. In some LDO voltage regulator designs, the P-channel pass transistor is driven by a voltage buffer which pushes the pole associated with the gate capacitance beyond the unity-gain frequency of the feedback loop of the voltage regulator. However, that technique is not suitable for PMOS LDO regulators that need to have a very low quiescent current.

Instead of dissipating a large amount of quiescent current in a voltage buffer as mentioned above, adding a zero in the voltage transfer characteristic of the regulator feedback loop may cancel the pole either from the gate capacitance of the PMOS pass device or from the output capacitor. In some cases, the zero can be obtained by using output capacitors with high equivalent series resistance (ESR). Nevertheless, the "ESR zero" type of compensation provided by the output capacitor is not very efficient in low quiescent current LDO regulator design, especially for the popular low ESR ceramic capacitors whose ESR zeros are far outside of the narrow bandwidth of the low bandwidth characteristic of low quiescent current LDO voltage regulators. Therefore, the "compensation zero" has to be created within the LDO feedback loop in most cases.

Adding a "compensation zero" type of compensation within the LDO feedback loop can achieve very good pole-zero cancellation if the specific values of the LDO voltage regulator output capacitance and its ESR are known. However, because of the wide ranges of output capacitance and the associated ESR values, the zero added into the transfer characteristic of the feedback loop always provides incomplete compensation under certain conditions, resulting in LDO regulator instability.

Referring to FIG. 1, a conventional PMOS linear voltage regulator 1 includes a P-channel pass transistor $MP_{pass}$ which operates as a current source controlled by an error amplifier 2 having a transconductance $g_{mi}$. The capacitance $C_1$ connected between the gate and source of pass transistor $MP_{pass}$ is $C_{CH}+C_{gs}$ (the sum of the channel capacitance $C_{CH}$ and gate-source overlap capacitance $C_{gs}$), and $C_c$ is the gate-drain overlap capacitance $C_{gd}$. For short channel transistors, $C_{gs}$ and $C_{gs}$ are comparable to $C_{CH}$. The transconductance $g_{mo}$ of pass transistor $MP_{pass}$ is a function of the load current $I_L$ flowing out of the drain of the pass transistor. It should be noted that without a voltage buffer of the kind mentioned above, the conductor 3 connected to the gate of pass transistor $MP_{pass}$ is a gain node which presents a pole. The pole is related to the gate capacitance of pass transistor $MP_{pass}$ and the output resistance $r_{ol}$ of error amplifier 2. The load capacitance $C_L$ provided by the user causes another pole that is inversely proportional to the product of $C_L$ and $R_L$, where $R_L$ is the small signal resistance seen at conductor 4 and includes the load resistance, the divider, and the output resistance $r_o$ of pass transistor $MP_{pass}$.

Therefore, the PMOS LDO voltage regulator 1 in FIG. 1 is a two-pole system which may have very low phase margin under certain load conditions. Due to the different natures of various applications, the equivalent AC load may be either a passive load such as a resistor or an active load such as a current source. The uncertainty regarding the AC impedance of the load makes the design of PMOS LDO voltage regulator 1 very difficult, because the output pole has a strong dependence on the equivalent AC load. Nevertheless, in almost all situations the DC gain $g_{mo}R_L$ from the gate conductor 3 to the output conductor 4 is much greater than 1 (i.e., $g_{mo}R_L>>1$), which is quite different from the N-channel pass transistor case in which the NMOS source follower provides a DC gain very close to unity.

The AC voltage gain $v_o/v_i$ (where $v_o$ is Vout and $v_i$ is Vin) of the loop can be found as follows, for $C_L>>C_c$:

$$\frac{v_o}{v_i} = \frac{g_{mi}r_{01}g_{mo}R_L(1 - sC_c/g_{mo})}{1 + s[C_LR_L + (C_1 + C_c)r_{01} + g_{mo}R_LC_cr_{01}] + s^2r_{01}R_L(C_1 + C_c)C_L}. \quad \text{Eq. (1)}$$

From the denominator of Eq. (1) it can be seen that there are two poles. For any particular design, the values of $C_1$, $C_c$, and $r_{ol}$ are given and the poles are functions of $C_L$ and $R_L$. Instead of solving Eq. (1), the manner in which the magnitudes and phases of the poles change with respect to $C_L$ and $R_L$ can be determined for a fixed value of load resistance $R_L$. For a very large $C_L$, the dominant pole $p_1$ and the non-dominant pole $p_2$ are obtained by factoring the second-order denominator as:

$$p_1 = \frac{1}{C_LR_L}, \text{ and} \qquad p_2 = \frac{1}{(C_1 + C_c)r_{01}}. \quad \text{Eq. (2)}$$

(For more information, see page 241 et seq. of "Analog Integrated Circuit Design", by D. Johns, and K. Martin, John Wiley & Sons, 1997.) However, for very small $C_L$, the dominant pole $p_1$ and the non-dominant pole $p_2$, respectively, are given by:

$$p_1 = \frac{1}{g_{mo}R_LC_cr_{01}}, \text{ and} \qquad p_2 = \frac{g_{mo}}{C_L} \times \frac{C_c}{C_1 + C_c}. \quad \text{Eq. (3)}$$

Sketches of poles $p_1$ and $p_2$ versus $C_L$ for a fixed $R_L$ are shown in FIG. 2A. For a very small value of load capacitance $C_L$, the value of the dominant pole $p_1$ does not change with $C_L$ and can be attributed to the Miller capacitor $C_c$, and the value of non-dominant pole $p_2$ moves away from that of the dominant pole $p_1$ as the capacitance $C_L$ decreases, as shown in FIG. 2A. On the other hand, for a very large $C_L$, the dominant pole $p_1$ is attributed to $C_L$ and it moves away from the non-dominant pole $p_2$ which stays at $$\frac{1}{(C_1 + C_c)r_{01}}.$$

as $C_L$ increases. The magnitudes of poles $p_1$ and $p_2$ are the closest when $C_L = g_{mo} r_{ol} C_c$ indicating that the load capacitor and the Miller capacitor pole have the same amount of delay and neither is dominant. Under that worst case condition, $$p_1 = \frac{1}{g_{mo} R_L C_c r_{01}} = \frac{1}{C_L R_L}, \text{ and} \quad \text{Eq. (4)}$$

$$p_2 = \frac{1}{(C_1 + C_c) r_{01}}.$$

The worst case Q factor is $$Q = \left[\frac{A_0 p_1}{p_2}\right]^{1/2} = \left[g_{mi} r_{01} \frac{C_c}{C_1 + C_c}\right]^{1/2}, \text{ where} \quad \text{Eq. (5)}$$

$$A_0 = g_{mi} r_o g_{mo} R_L.$$

This is for the case in which the feedback loop has unity gain. In Eq. (5), $A_0 = g_{mi} r_o g_{mo} R_L$ is the overall DC gain of the loop.

The foregoing analysis reveals the poles changing with $C_L$ for a fixed load $R_L$. However, in a typical LDO application, the load changes while $C_L$ is provided by the user and kept as a constant. Thus, it would provide a better insight to analyze the poles changing with load $R_L$, or $g_{mo}$, for a fixed $C_L$. Nevertheless, plotting poles $p_1$ and $p_2$ versus $g_{mo}$ is not as straightforward as plotting them versus $C_L$ because $g_{mo}$ and $R_L$ have no simple relationship. The complexity results not only from the strong application dependencies of $R_L$ as pointed out previously, but also from the nonlinear dependency of $g_{mo}$ on the load current $I_L$ flowing out of the drain of pass transistor $MP_{pass}$. In fact, $g_{mo}$ is proportional to $I_L$ when pass transistor $MP_{pass}$ is in sub-threshold operation for a very light load current, whereas it is proportional to $(I_L)^{1/2}$ when the pass transistor $MP_{pass}$ is in saturation for a heavy load current. However, in the current range in which the two capacitors "fight for dominance", pass transistor $MP_{pass}$ is still in sub-threshold operation, which will be shown later. In the sub-threshold operating region, $g_{mo} R_L$ can be taken as a constant because $g_{mo}$ is proportional to $I_L$ while $R_L$ is inversely proportional to $I_L$.

Again, by using a similar asymptotic approach, poles $p_1$ and $p_2$ can be derived by factoring the denominator of Eq. (1) and are given by Eq. (2) for small $g_{mo}$ (or large $R_L$) and by Eq. (3) for large (or small $R_L$), respectively. Based on Eqs. (2) and (3), poles changing with $g_{mo}$ can be sketched as in FIG. 2B, assuming $g_{mo} R_1$ is a constant. For a small value of $g_{mo}$, the dominant pole $p_1$ can be attributed to the load capacitor $C_L$ and its value moves away from the value of the non-dominant pole $p_2$ as $g_{mo}$ decreases (or as $R_L$ increases) while pole $p_2$ stays at $$\frac{1}{(C_1 + C_c) r_{01}}.$$

On the other hand, for a large value of $g_{mo}$, the value of dominant pole $p_1$ does not change with $g_{mo}$ and can be attributed to the Miller capacitor $C_c$, and the value of non-dominant pole $p_2$ moves away from pole $p_1$ as $g_{mo}$ increases. The magnitudes of poles $p_1$ and $p_2$ are the closest when $$g_{mo} = \frac{C_L}{C_c r_{01}}, \quad \text{Eq. (6)}$$

wherein the load capacitor and the Miller capacitor cause the same amount of delay and neither of them is dominant. Under that condition, the LDO regulator feedback loop has its lowest phase margin, with the pole locations and the Q factor given by Eqs. (4) and (5), respectively.

Not surprisingly, both analyses, poles vs $C_L$ and poles vs $g_{mo}$, give the same worst case condition. To summarize, poles $p_1$ and $p_2$ can be attributed to $C_L$ and $C_c$ only when poles $p_1$ and $p_2$ are widely separated. For small $g_{mo}$, $p_1$ can be attributed to the load capacitor pole; for large gmo, $p_1$ can be attributed to the Miller capacitance pole. For $g_{mo}$ around the value give by Eq. (6), $p_1$ can not be attributed to either of them.

It also can be seen from Eq. (2) and Eq. (3) that the curves of poles $p_1$ and $p_2$ versus $g_{mo}$ shift horizontally for different values of the user-provided load capacitance $C_L$. Poles $p_1$ and $p_2$ versus $g_{mo}$ with a larger value of $C_L$ are shown as dashed lines in FIG. 2B. Since the worst case Q factor is independent of $C_L$, there is always a minimum phase margin at a certain load condition for whatever load capacitance is being used.

FIG. 3 shows the simulated phase margins at unity gain versus load current for $C_L$=μF (Curve A), 10 μF (Curve B), and 100 μF (Curve C) for the simple topology PMOS LDO of FIG. 1, illustrating the existence of a minimum phase margin irrespective of load capacitance. Curves A, B and C exhibit approximately 1 degree of phase margin at load currents $I_L$ of 300 nA, 3 uA, and 30 uA for $C_L$=1 μF, 10 μF, and 100 μF respectively. With those currents, the pass transistor $MP_{pass}$ with a W/L ratio of 50,000 microns/0.8 micron, still operates in its sub-threshold region, which supports the assumption that $g_{mo} R_L$ is a constant.

FIGS. 4A-C show the overall open loop gain Bode plots as solid lines for the simple LDO topology, representing the cases (a) when the output capacitor dominates the frequency response, i.e., $$\frac{1}{C_L R_L} < \frac{1}{g_{mo} R_L C_c r_{01}};$$

(b) when the output capacitor and the Miller capacitor are equally strong in frequency response, i.e., $$\frac{1}{C_L R_L} = \frac{1}{g_{mo} R_L C_c r_{01}};$$

and (c), when the Miller capacitor dominates, $$\frac{1}{C_L R_L} > \frac{1}{g_{mo} R_L C_c r_{o1}},$$

respectively. The dashed lines 9-4 and the dot-dash lines 9-2 indicate the gains from the pass transistor gate to the output and from the input of error amplifier 2 to its output, respectively. In FIG. 4A where the output capacitor dominates, the corner frequency $1/(C_L R_L)$ of curve 9-4, is on the left hand side of the corner frequency of curve 9-2. The product of curve 9-2 and curve 9-4 gives the overall open loop gain, 9-1. FIGS. 4B and 4C can be analyzed similarly.

In summary, the prior art PMOS LDO voltage regulator of FIG. 1 possesses significant stability shortcomings. It has been shown that under the worst case condition, the Q factor of the closed loop is given by Eq. (5) as $[g_{mi}r_{ol}C_c/(C_c+C_1)]^{1/2}$. Q could be as large as approximately 30, since $g_{mi}r_{ol}$ could be 60 to 70 dB while $C_c/(C_c+C_1$ is on the order of 1, implying a very low phase margin and, as demonstrated in FIG. 3, leading to very poor transient performance under the worst case condition.

Thus, there is an unmet need for a PMOS LDO voltage regulator which has ultra-low quiescent current and which provides stable operation substantially irrespective of the load supplied thereby.

SUMMARY OF THE INVENTION

It is an object of the present invention to provide an LDO voltage regulator which has ultra-low quiescent current and which provides stable operation substantially irrespective of the load supplied thereby.

It is another object of the invention to provide a PMOS LDO voltage regulator which has ultra-low quiescent current and which provides stable operation substantially irrespective of the load supplied thereby.

Briefly described, and in accordance with one embodiment, the present invention provides a low drop out (LDO) voltage regulator (10) which includes a pass transistor ($MP_{pass}$) having a first electrode coupled to an input voltage to be regulated and a second electrode coupled by an output conductor (4) to a load. An error amplifier (2) has a first input coupled to a reference voltage, a second input connected to a feedback conductor (4A), and an output coupled to a control electrode of the pass transistor. A parallel path transistor ($MP_{pa}$) has a first electrode coupled to the input voltage, a control electrode coupled to the output (3) of the error amplifier (2), and a second electrode coupled to the feedback conductor. A feedback resistor ($R_f$ and/or $R_2$) is coupled between the feedback conductor and the output conductor.

In one embodiment, the invention provides a low drop out (LDO) voltage regulator (10) including a pass transistor ($MP_{pass}$) having a first electrode coupled to an input voltage (Vin) and a second electrode coupled by an output conductor (4) to a load. An error amplifier (2) has a first input coupled to a reference voltage (Vref), a second input connected to a feedback conductor (4A), and an output (3) coupled to a control electrode of the pass transistor ($MP_{pass}$). A parallel path transistor ($MP_{pa}$) has a first electrode coupled to the input voltage (Vin), a control electrode coupled to the output (3) of the error amplifier (2), and a second electrode coupled to the feedback conductor (4A). A feedback resistance ($R_f$ and/or $R_2$) is coupled between the feedback conductor (4A) and the output conductor (4). In one embodiment, the pass transistor ($MP_{pass}$) and the parallel path transistor ($MP_{pa}$) are P-channel MOS transistors, and the first electrodes are sources, the second electrodes are drains, and the control electrodes are gates.

In one embodiment, the gate of the parallel path transistor ($MP_{pa}$) is coupled to the output (3) of the error amplifier (2) by means of an offset voltage source ($V_{OS}$). In one embodiment, the offset voltage source ($V_{OS}$) includes an offset resistor (15) coupled between the gate of the pass transistor ($MP_{pass}$) and the gate of the parallel path transistor ($MP_{pa}$), and also includes a first current source (16) coupled to a first terminal of the offset resistor (15) and a second current source (17) coupled to a second terminal of the offset resistor (15). In one embodiment, a third current source (19) is coupled between the input voltage (Vin) and the source of the parallel path transistor ($MP_{pa}$), a fourth current source (20) is coupled to the drain of the parallel path transistor ($MP_{pa}$), and a capacitor ($C_p$) is coupled between the input voltage (Vin) and the source of the parallel path transistor ($MP_{pa}$).

In one embodiment, the LDO voltage regulator includes a third current source (19) coupled between the input voltage (Vin) and the source of the parallel path transistor ($MP_{pa}$) a fourth current source (20) coupled to the drain of the parallel path transistor ($MP_{pa}$), and a fractional frequency response network (24) coupled between the input voltage (Vin) and the source of the parallel path transistor ($MP_{pa}$). In one embodiment, the fractional frequency response network (24) includes first ($r_o$), second ($r_1$), and third ($r_2$) MOS resistive elements each having a source coupled to the input voltage (Vin) and a gate coupled to a first bias voltage, and first ($c_0$), second ($c_1$), third ($c_2$), and fourth ($c_3$) capacitors. The first capacitor ($c_0$) is coupled between the input voltage (Vin) and a drain (28) of the first MOS resistive element ($r_o$). The second capacitor ($c_1$) is coupled between the drain (28) of the first MOS resistive element ($r_o$) and a drain (27) of the second MOS resistive element ($r_1$). The third capacitor ($c_2$) is coupled between the drain (27) of the second MOS resistive element ($r_1$) and a drain (26) of the third MOS resistive element ($r_2$), and the fourth capacitor ($c_3$) is coupled between the drain (26) of the second MOS resistive element ($r_1$) and the source (5A) of the parallel path transistor ($MP_{pa}$).

In one embodiment, a current limit transistor ($MP_{limit}$) has a source coupled to the drain of the parallel path transistor ($MP_{pa}$), a gate coupled to a second bias voltage ($V_{BIAS}$), and a drain coupled to the feedback conductor (4A).

In one embodiment, the error amplifier (2) includes first (MN0A) and second (MN0B) input transistors having sources coupled to a tail current transistor (MN3B). A gate of the first input transistor (MN0A) is coupled to the reference voltage (Vref), a gate of the second input transistor (MN0B) is coupled to the feedback conductor (4A), a drain of the first input transistor (MN0A) is coupled to a drain and gate of a first load transistor (MP1A) and a gate of a first current mirror output transistor (MP1B) having a drain coupled to a drain and gate of a first current mirror input transistor (MN2A) and a gate of a second current mirror output transistor (MN2B) which functions as the second current source (17). A drain of the second input transistor (MN0B) is coupled to a drain and gate of a second load transistor (MP1C) and a gate of a third current mirror output transistor (MP1D) which functions as the first current source (16). A P-channel fourth current mirror output transistor (MP2B) is coupled between the input voltage (Vin) and the source of the parallel path transistor ($MP_{pa}$) and functions as the third current source (19) and has a gate coupled to a gate and drain of a P-channel second current mirror input transistor (MP2A) and a drain of a N-channel fifth current mirror output transistor (MN4E) having a gate coupled to a gate and drain of a N-channel third current mirror input transistor (MN4A). A N-channel sixth current mirror output transistor (MN4D) has a drain coupled to the feedback conductor (4A) and a gate coupled to the gate and drain of the third current mirror input transistor (MN4A). A N-channel seventh current mirror output transistor (MN4C) has a gate coupled to the gate and drain of the third current mirror input transistor (MN4A) and a drain coupled to a gate and drain of a first diode-connected P-channel transistor (MP3) and the gates of the first ($r_o$), second ($r_1$), and third ($r_2$) MOS resistive elements, and a N-channel eighth current mirror output transistor (MN4B) having a drain coupled to the gate of the current limit transistor ($MP_{limit}$) and a gate and drain of a second diode-connected P-channel transistor (MP4) and a gate coupled to the gate and drain of the third current mirror input transistor (MN4A), the third current mirror input transistor (MN4A) having its gate and drain coupled to a bias current source ($I_{BIAS2}$).

In one embodiment, the invention provides a method of operating a low drop out (LDO) voltage regulator (10) with low quiescent current and at least a predetermined phase margin despite large variations in load current, the method including applying an input voltage (Vin) to a first electrode of a pass transistor ($MP_{pass}$) and coupling a second electrode of the pass transistor ($MP_{pass}$) to an output conductor (4) applying an output voltage (Vout) to a load, coupling a first input of an error amplifier (2) to a reference voltage (Vref), and coupling an output (3) of the error amplifier (2) to a control electrode of the pass transistor ($MP_{pass}$), coupling a feedback resistance ($R_f$ and/or $R_2$) between the output conductor (4) and a second input of the error amplifier (2), and compensating the LDO voltage regulator (10) by coupling a parallel path transistor ($MP_{pa}$) between the input voltage (Vin) and the second input of the error amplifier (2) and by coupling a control electrode of the parallel path transistor ($MP_{pa}$) to the output of the error amplifier (2).

In one embodiment, the method includes applying an offset voltage ($V_{OS}$) between the control electrode of the pass transistor ($MP_{pass}$) and the control electrode of the parallel path pass transistor ($MP_{pa}$) In one embodiment, the applying of the offset voltage ($V_{OS}$) includes forcing a current through an offset resistor (15) to generate the offset voltage ($V_{OS}$) and coupling a first current source (19) between the input voltage (Vin) and the first electrode of the parallel path transistor ($MP_{pa}$), coupling a fourth current source (20) to the second electrode of the parallel path transistor ($MP_{pa}$), and coupling capacitive circuitry ($C_p$) between the input voltage (Vin) and the first electrode of the parallel path transistor ($MP_{pa}$).

In one embodiment, the method includes providing the capacitive circuitry in the form of a fractional frequency response network (24) coupled between the input voltage (Vin) and the first electrode of the parallel path transistor ($MP_{pa}$). In one embodiment, the method includes coupling a current limit transistor ($MP_{limit}$) between the second electrode of the parallel path transistor ($MP_{pa}$) and the second input (4A) of the error amplifier (2), and coupling a control electrode of the current limit transistor ($MP_{limit}$) to a second bias voltage ($V_{BIAS}$).

In one embodiment, the invention provides a low drop out (LDO) voltage regulator (10) with low quiescent current and at least a predetermined phase margin despite large variations in load current, including a pass transistor ($MP_{pass}$) and means (5) for applying an input voltage (Vin) to a first electrode of the pass transistor ($MP_{pass}$) and means (4) for coupling a second electrode of the pass transistor ($MP_{pass}$) to apply an output voltage (Vout) to a load, means for coupling a first input of an error amplifier (2) to a reference voltage (Vref) and means (3) for coupling an output of the error amplifier (2) to a control electrode of the pass transistor ($MP_{pass}$), means (4A,4,$R_2$) for coupling a feedback resistance ($R_f$) between the output voltage (Vout) and a second input of the error amplifier (2), and parallel path means ($MP_{pa}$) coupled between the input voltage (Vin) and the second input of the error amplifier (2) for compensating a feedback loop of the LDO voltage regulator (10).

DETAILED DESCRIPTION OF THE PREFERRED EMBODIMENTS

In battery-powered applications, low dropout (LDO) linear regulators with ultra-low quiescent currents have become more and more desirable, since they greatly increase power efficiency and thereby extend battery operating life. However, design of an ultra-low quiescent current LDO PMOS voltage regulator (e.g., with quiescent current in the microampere range) presents a great challenge. With only a small amount of current available to power the voltage regulator control circuit, the circuit topology must be kept as simple as possible.

Figure 1:
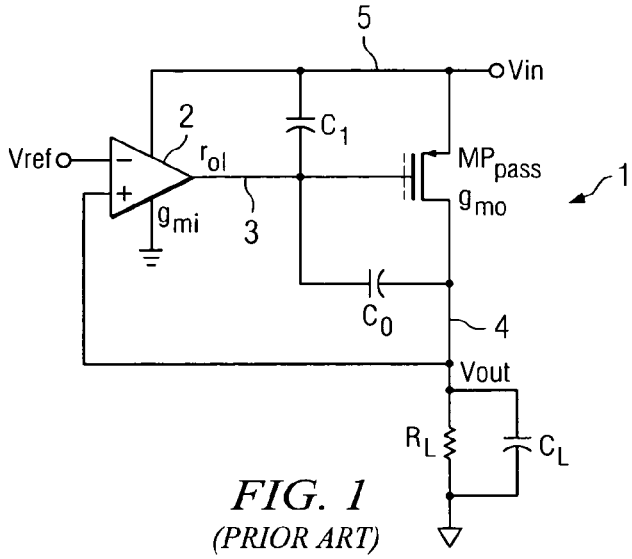
FIG. 1 (PRIOR ART)
FIG. 1 is a schematic diagram of a conventional LDO voltage regulator having a P-channel pass transistor.
Figure 2A:
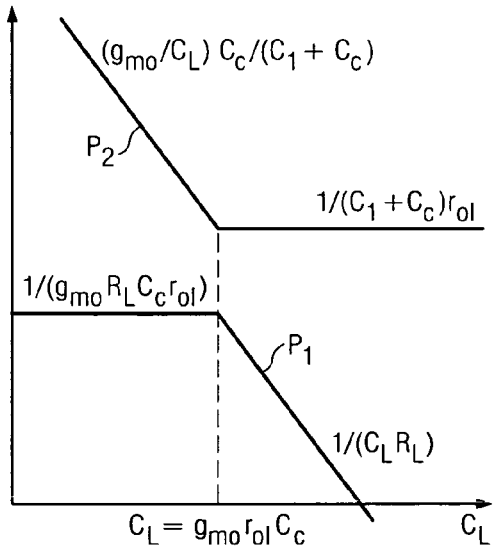
FIG. 2A (PRIOR ART)
FIGS. 2A and 2B are sketches of the dominant and non-dominant poles with logarithmic scales for the voltage regulator of FIG. 1, showing poles as a function of $C_L$ with $R_L$ fixed and as a function of $g_{mo}$ with $C_L$ fixed, respectively.
Figure 2B:
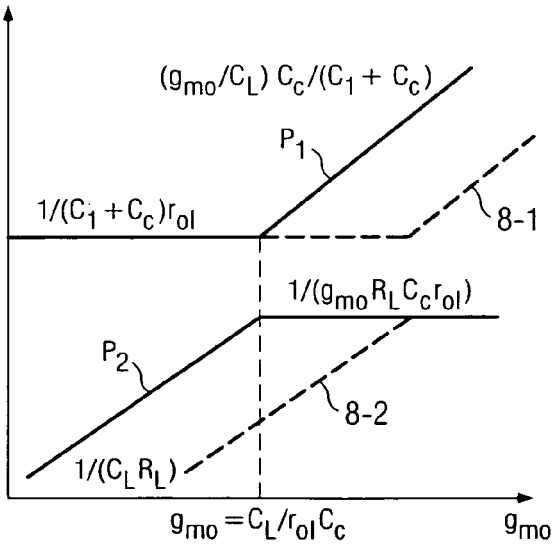
FIG. 2B (PRIOR ART)
Figure 3:
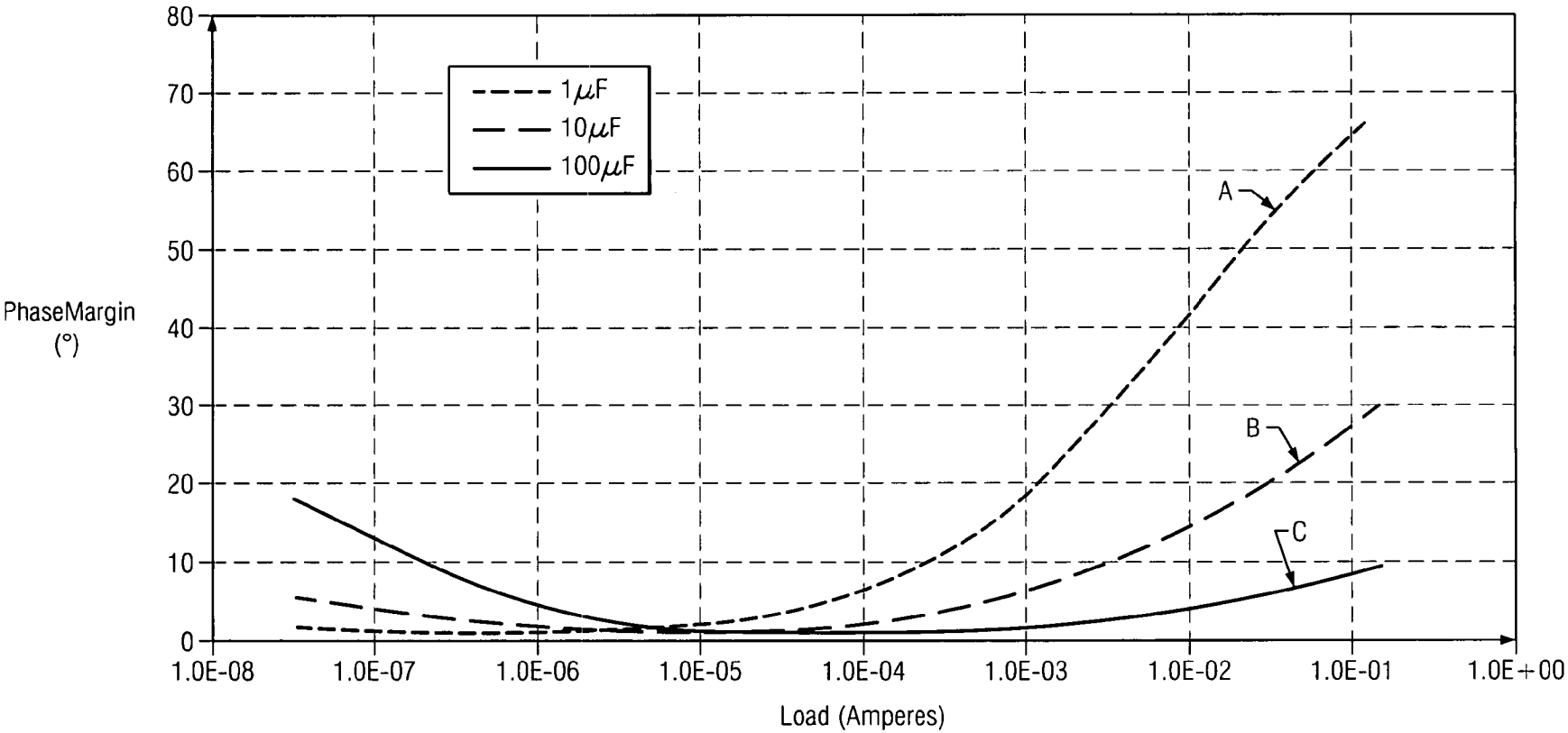
FIG. 3 (PRIOR ART)
FIG. 3 is a plot showing the unity gain phase margin of the voltage regulator of FIG. 1 versus its load with $C_L$=1 μF, 10 μF, and 100 μF.
Figure 4A:
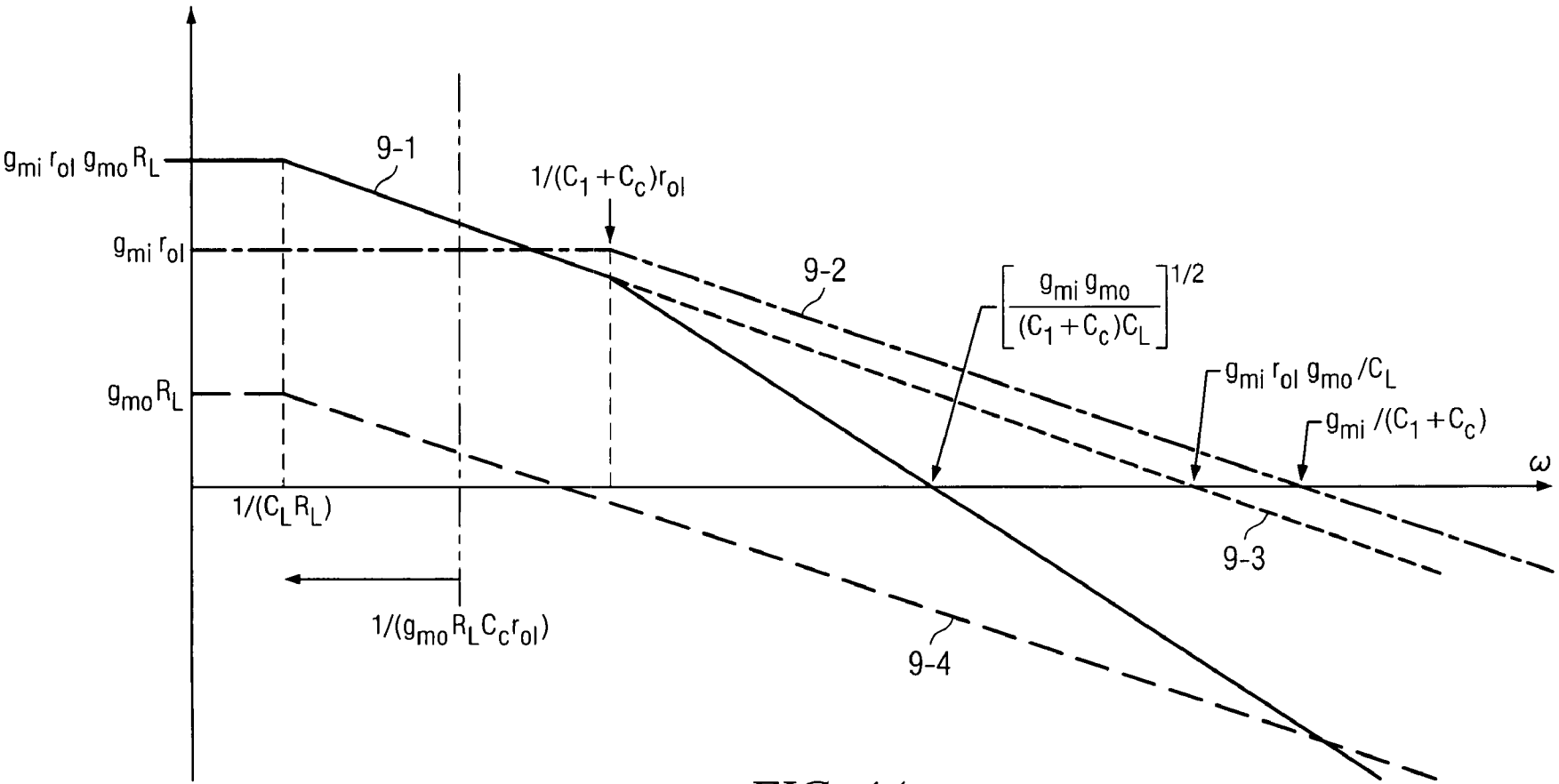
FIG. 4A (PRIOR ART)
FIGS. 4A-C are Bode plots for the voltage regulator of FIG. 1 for the cases when the output capacitor is dominant, the output capacitor and Miller capacitor are equally strong, and the Miller capacitor is dominant, in frequency response, respectively.
Figure 4B:
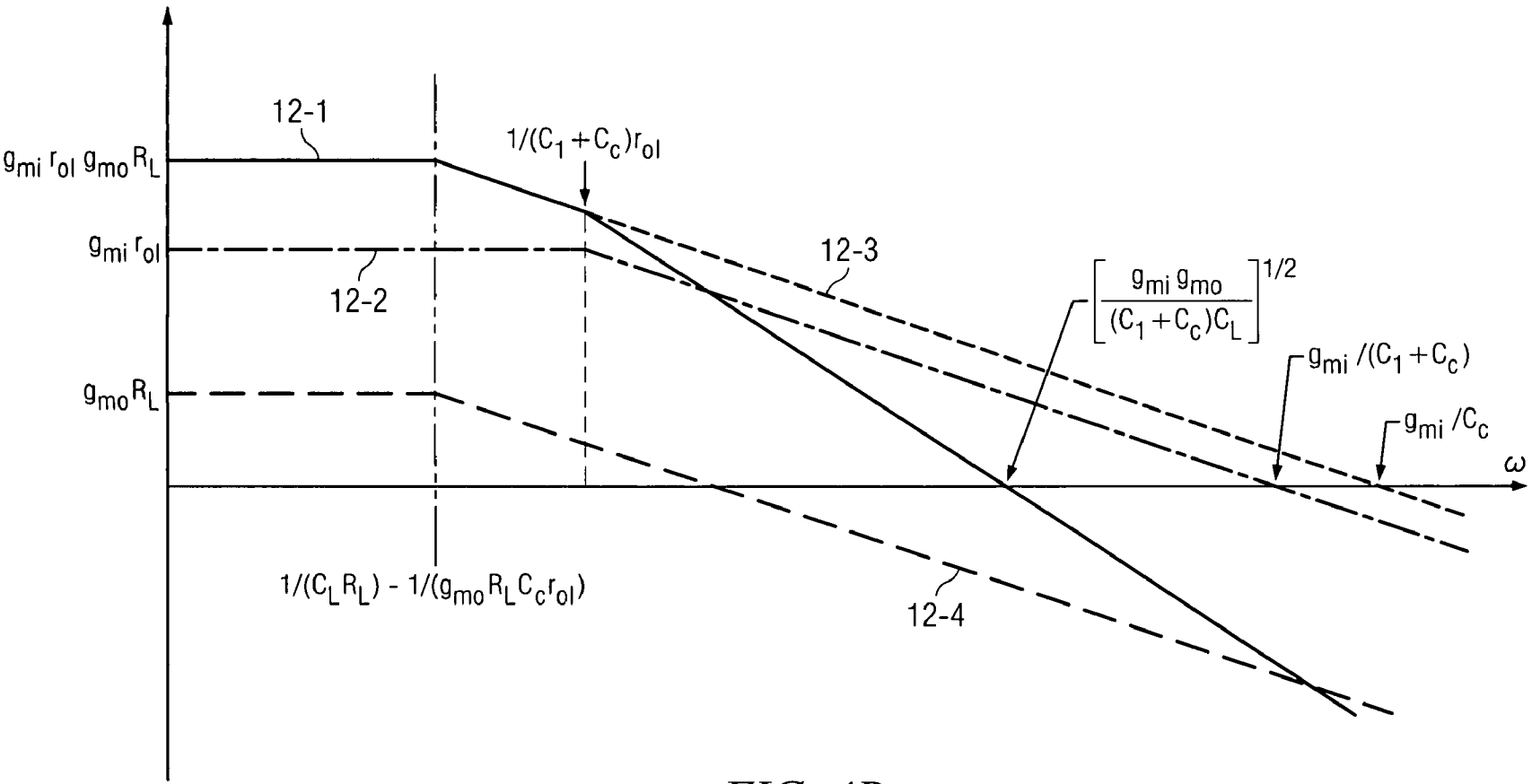
FIG. 4B (PRIOR ART)
Figure 4C:
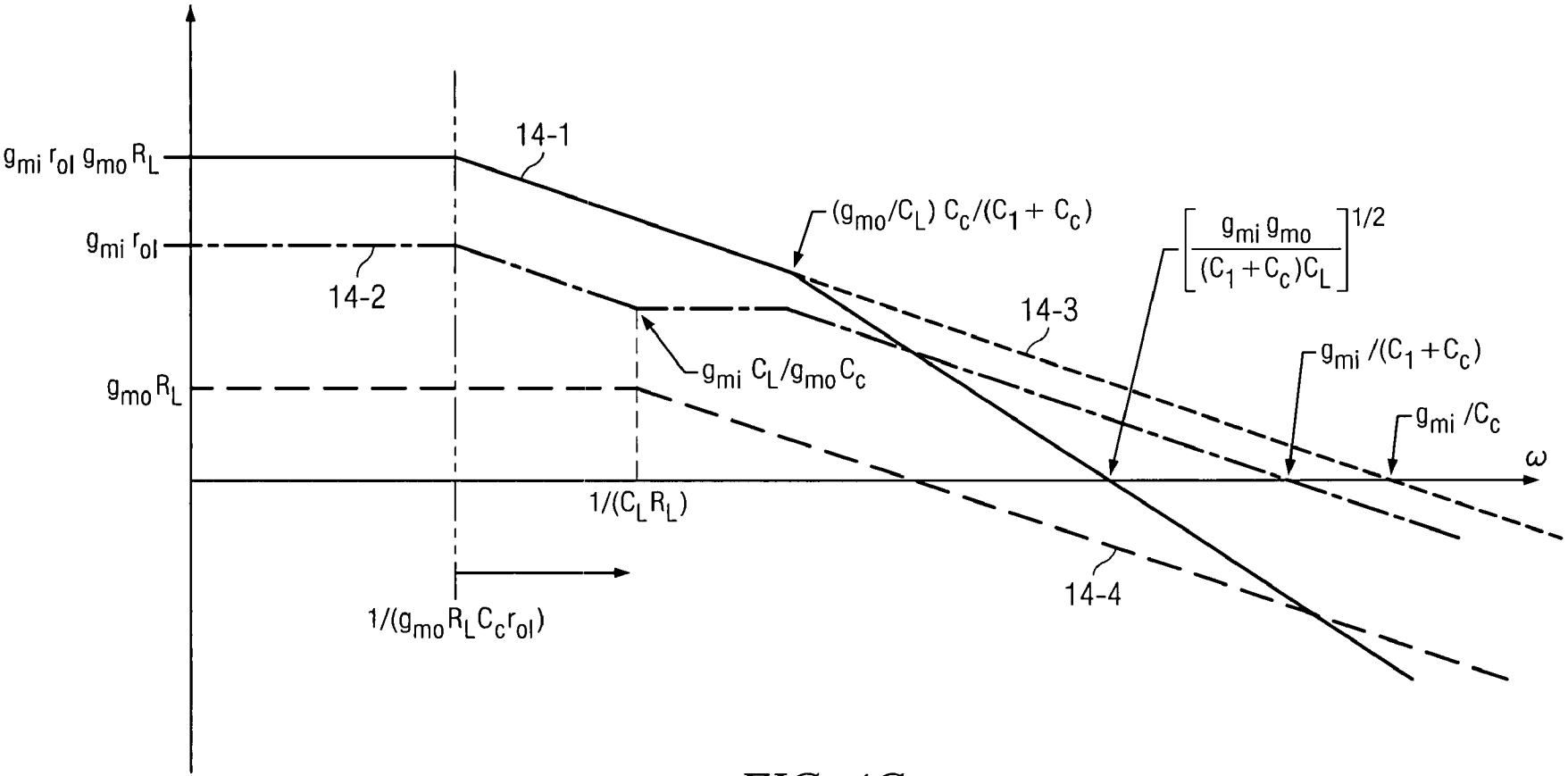
FIG. 4C (PRIOR ART)
Figure 5:
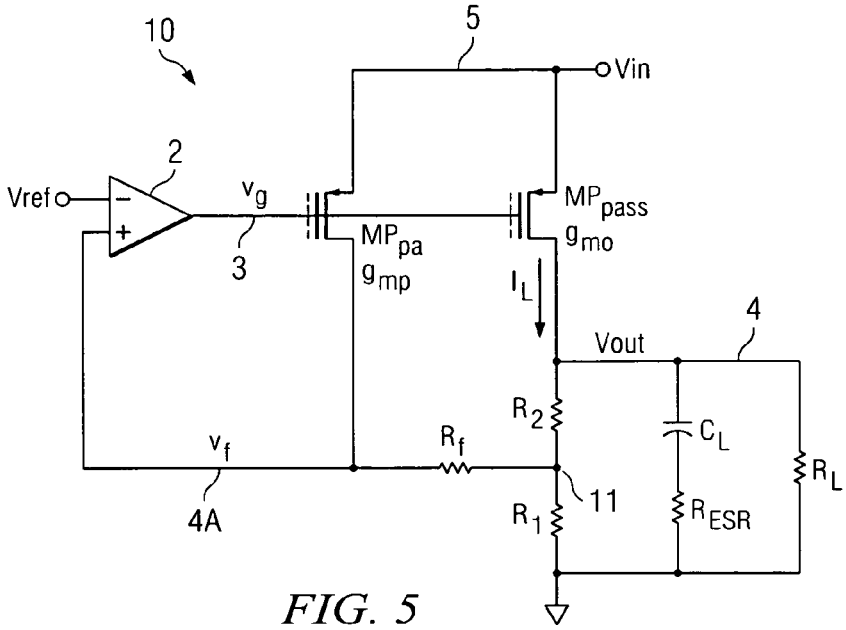
FIG. 5 is a schematic diagram which shows the control loop of a LDO voltage regulator having a P-channel pass transistor and also having a parallel signal path from the pass transistor gate voltage $v_g$ to the feedback voltage $v_f$ in accordance with the present invention.

Referring to FIG. 5, a PMOS linear voltage regulator 10 in accordance with the present invention includes a P-channel pass transistor $MP_{pass}$ which operates as a current source that is controlled by an error amplifier 2 having a transconductance $g_{mi}$. The (−) input of error amplifier 2 is coupled to a reference voltage Vref. Error amplifier 2 can be powered by Vin and referenced to ground. The drain of pass transistor $MP_{pass}$ is connected to Vin conductor 5, its gate is connected to error amplifier output conductor 3, and its source is connected to Vout conductor 4. The transconductance $g_{mo}$ of pass transistor $MP_{pass}$ is a function of the total DC load current $I_L$ flowing through both internal and external DC components connected to conductor 4, including the current through resistor $R_L$ and the current through the divider including resistors $R_2$ and $R_1$ which sets the output voltage of voltage regulator 10. The output capacitor $C_L$, which is also connected to conductor 4, presents an AC load to the LDO. The equivalent ESR resistance $R_{ESR}$ associated with load capacitor $C_L$ is shown coupled between the lower terminal of capacitor $C_L$ and ground in FIG. 5, and also in subsequently described FIG. 11.

In LDO voltage regulator 10 of FIG. 5, a compensation zero is added to the voltage transfer characteristic by means of a parallel signal path including P-channel transistor $MP_{pa}$, having its source coupled to Vin conductor 5, its gate connected to conductor 3, and its drain connected by feedback conductor 4A to the (+) input of error amplifier 2 and to one terminal of a feedback resistor $R_f$. Moreover, the other terminal of feedback resistor $R_f$ is connected by conductor 11 to the connection point between resistors $R_1$ and $R_2$. Resistor $R_1$ is connected between conductor 11 and ground, and resistor $R_2$ is connected between conductor 11 and Vout conductor 4. (However, feedback resistor $R_f$ is needed only if $R_2$=0.) Parallel signal path transistor $MP_{pa}$ is designed to have a very small ratio to the pass transistor, which converts the gate signal $v_g$ into a current signal being injected into the feedback network including resistors $R_f$, $R_1$ and $R_2$, as shown in FIG. 5. The added "zero" tracks the pole associated with $C_L$ to make the compensation effective for a wide range of output capacitor values $C_L$ and associated ESR (equivalent series resistance) values.

Figure 6:
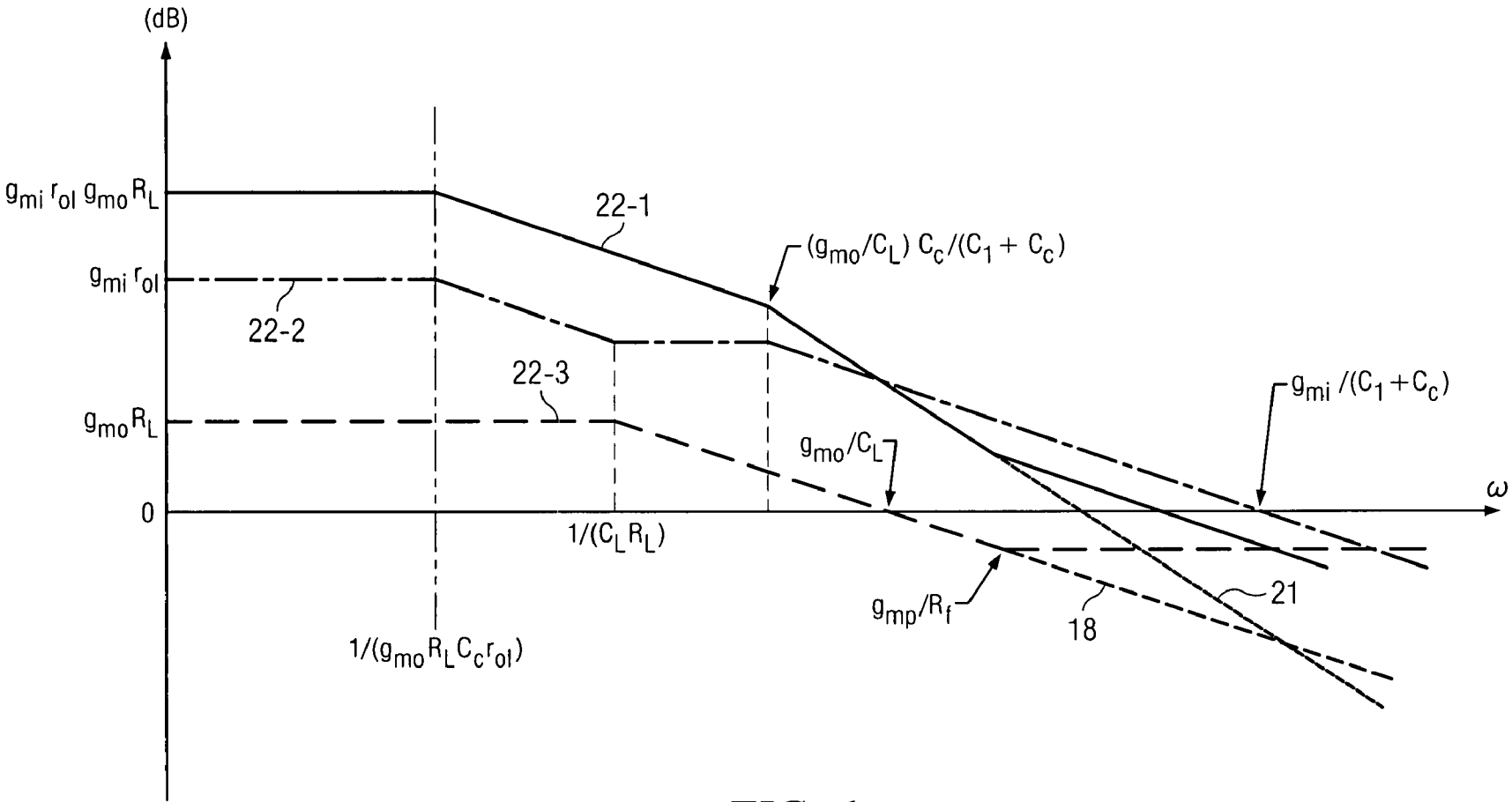
FIG. 6 is a Bode plot which shows gain versus frequency for a LDO voltage regulator having the parallel signal path shown in FIG. 5.

The Bode plot for LDO voltage regulator 10 of FIG. 5 is shown as solid line 22-1 in FIG. 6. The gain from node 4A to node 3 is shown as dash-dot lines 22-2, and the gain from node 3 to node 4 is shown as dash lines 22-3. The product of the values represented by lines 22-2 and 22-3 provides the overall open loop gain represented by line 22-1. The contribution to the feedback signal $v_f$ from parallel signal path transistor $MP_{pa}$ is approximately $g_{mp}(R_f+R_2/R_1)$, wherein $g_{mp}$ is the transconductance of parallel path transistor $MP_{pa}$. Feedback resistor $R_f$ is only needed to isolate transistor $MP_{pa}$ from the load capacitor $C_L$ for the unity gain configuration wherein $R_2$ is replaced by a short circuit (as in subsequently described FIG. 11).

Without the foregoing parallel signal path, the gain from node 3 to node 4, represented by line 22-3, would roll off at −20 dB per decade, passing the 0 dB line as shown in the Bode plot of FIG. 6 at $g_{mo}/C_L$ and continuing along the thin dashed line 18. This causes the overall loop gain 22-1 in FIG. 6 to roll off at −40 dB per decade along the dash line 21, resulting in a low phase margin.

With the foregoing parallel signal path through transistor $MP_{pa}$ present, the roll-off signal through pass transistor $MP_{pass}$ encounters and combines with the signal through parallel signal path transistor $MP_{pa}$, $g_{mp}R_f$ (for the unity feedback case wherein $R_2$=0), and ceases being dominant. The gain 22-3 will no longer roll off along line 18, and instead makes a turn at the frequency $$\frac{g_{mo}}{C_L} \times \frac{1}{g_{mp}R_f}.$$

In other words, a zero at the frequency $$\frac{g_{mo}}{C_L} \times \frac{1}{g_{mp}R_f}$$

changes the overall gain roll-off back to −20 dB per decade. That zero tracks the pole $$\frac{g_{mo}}{C_L} \times \frac{C_c}{C_1 + C_c},$$

irrespective of how the load or the output capacitor changes. Reasonable phase margin can be achieved by properly choosing the product $g_{mp}R_f$. It should be noted that trade-offs need to be made in choosing the product $g_{mp}R_f$. Specifically, if $g_{mp}R_f$ is chosen to be greater than 1, the zero occurs at a lower frequency than the non-dominant pole $p_2$ and the feedback loop is well compensated. However, the signal from the parallel path including transistor $MP_{pa}$ becomes so strong that it significantly undermines the feedback loop controlling the main signal path through $MP_{pas}$, leading to large transient undershoot and overshoot in Vout on conductor 4. On the other hand, if $g_{mp}R_f$ is chosen to be much less than 1, the feedback loop may not be compensated enough. In this design, the value of $g_{mp}R_f$=0.2 may be used.

The current in transistor $MP_{pa}$ is a scaled-down mirror current of that in pass transistor $MP_{pass}$. The solution of providing the parallel signal path including transistor $MP_{pa}$ as indicated in FIGS. 5 and 6 works for AC signals, but has problems from a DC point of view. First, transistor $MP_{pa}$ injects DC current into feedback node 4A, which causes a DC error resulting in a regulation accuracy problem. Second, that DC current changes with the output load. This implies that the DC error will change with the load, which degrades the load regulation accuracy. Third, when the load current is low, $g_{mp}$ is too small to make any noticeable contribution to the regulator gain function and the loop compensation.

Figure 7A:
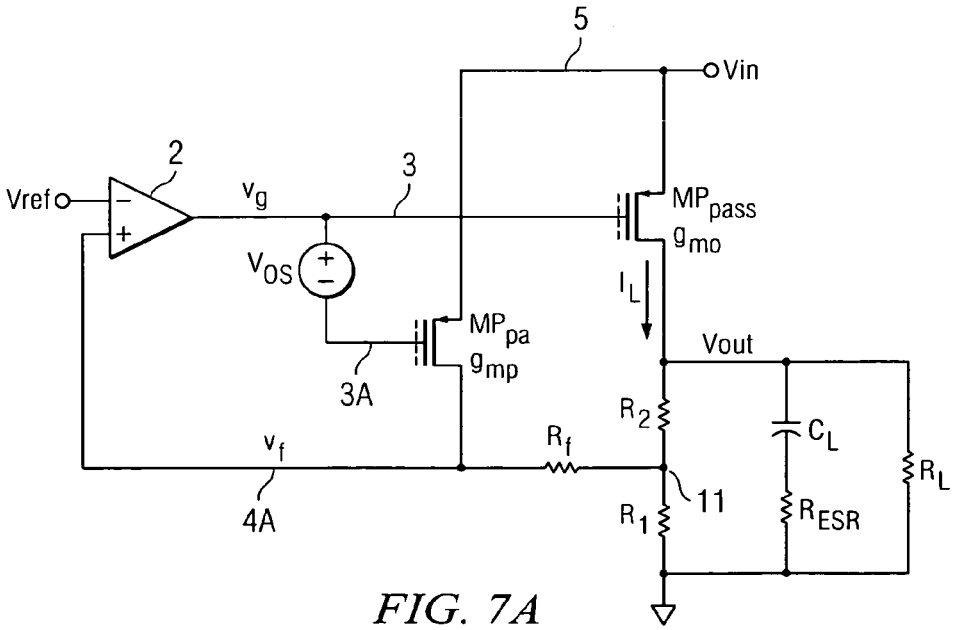
FIGS. 7A-C are schematic diagrams of implementations of the parallel signal path shown in FIG. 5 wherein an offset voltage $V_{OS}$ is needed to make the parallel signal path adequately strong even though the pass transistor is in deep sub-threshold operation.
Figure 7B:
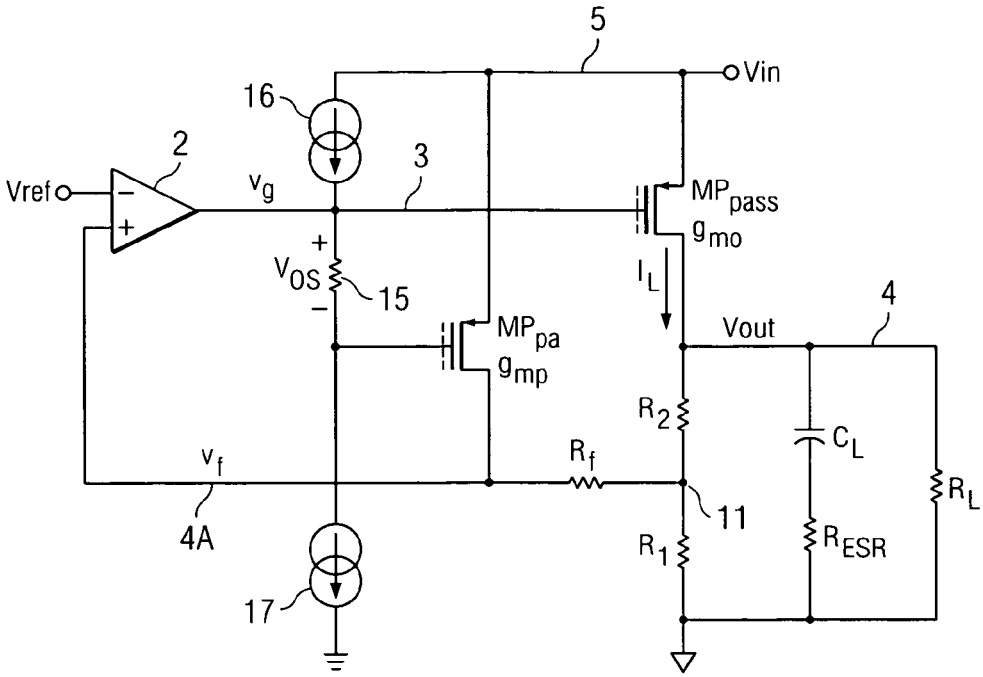
Figure 7C:
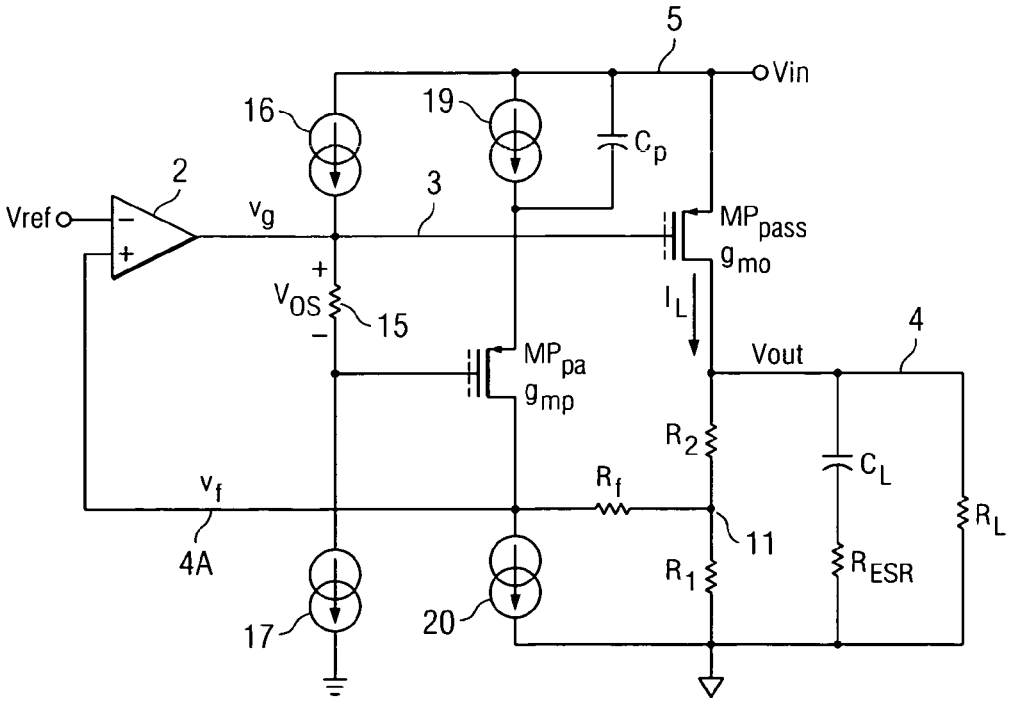

The above mentioned first and the second problems can be resolved by inserting transistor $MP_{pa}$ into a circuit leg having 2 identical current sources 19 and 20 as shown in FIG. 7C. Then the current through transistor $MP_{pa}$ will no longer change with the load. Moreover, there is no net DC current injected into the R1 and R2 divider except for a small amount of mismatch current. However, a large capacitor $C_p$ is needed at the source of $MP_{pa}$ so that the AC signal can go from gate 3 to node 4A through transistor $MP_{pa}$.

The above mentioned third problem is resolved by introducing a DC offset voltage $V_{OS}$ between the gates of pass transistor $MP_{pass}$ and parallel path transistor $MP_{pa}$ as indicated in FIG. 7A. With a properly chosen $V_{OS}$, parallel path transistor $MP_{pa}$ is still has enough gate drive and its $g_{mp}$ is "strong enough" to convert the voltage signal on gate 3A of parallel path transistor $MP_{pa}$ to an effective current signal, even though transistor $MP_{pass}$ is in deep sub-threshold operation. FIG. 7B shows resistor 15 as an implementation of the offset voltage $V_{OS}$.

Figure 8A:
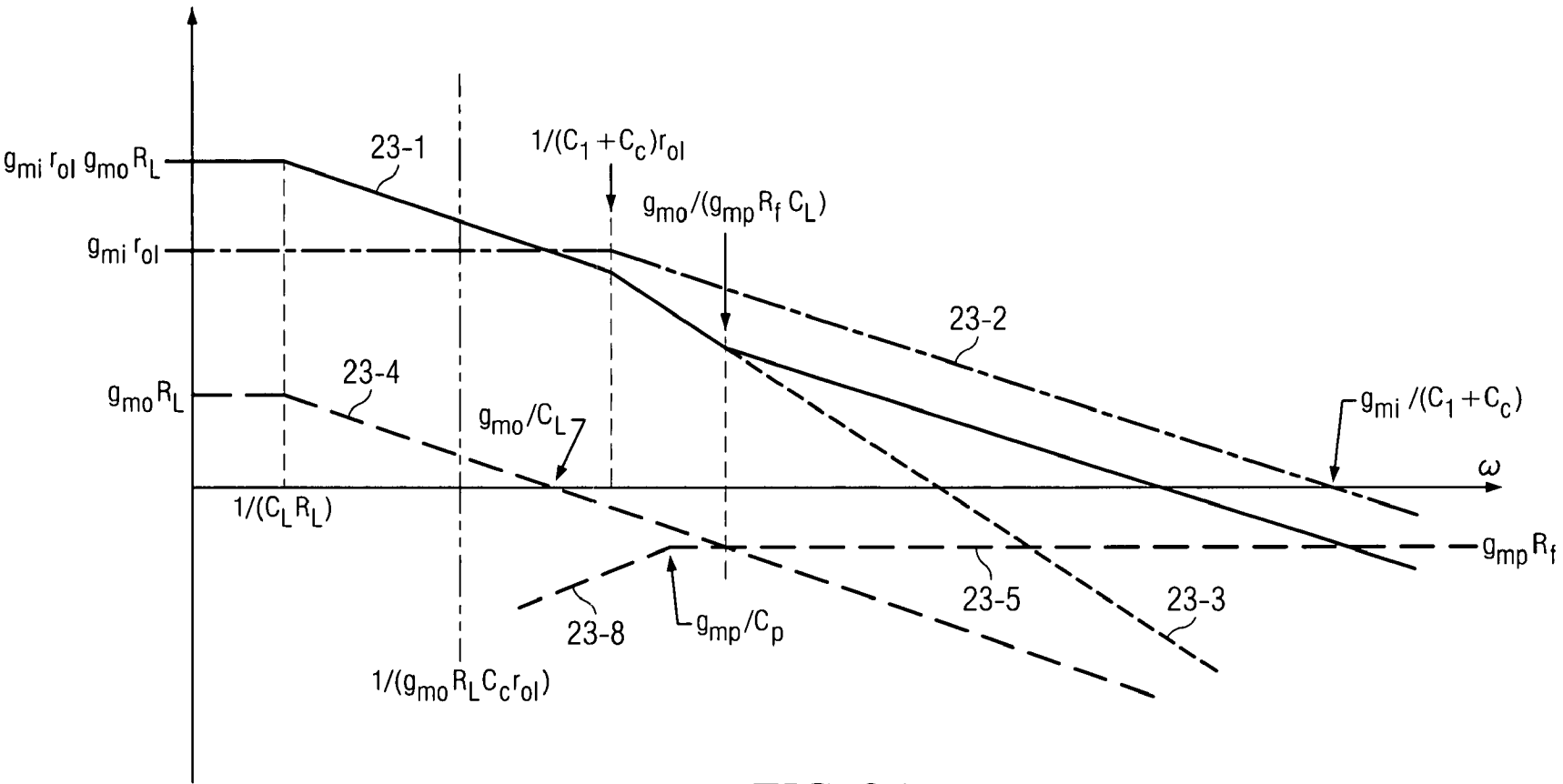
FIGS. 8A and 8B are Bode plots for the voltage regulator of FIG. 7C which illustrate that large $C_p$ is needed in order to avoid a gain notch which may cause circuit instability and failure of the parallel path compensation.
Figure 8B:
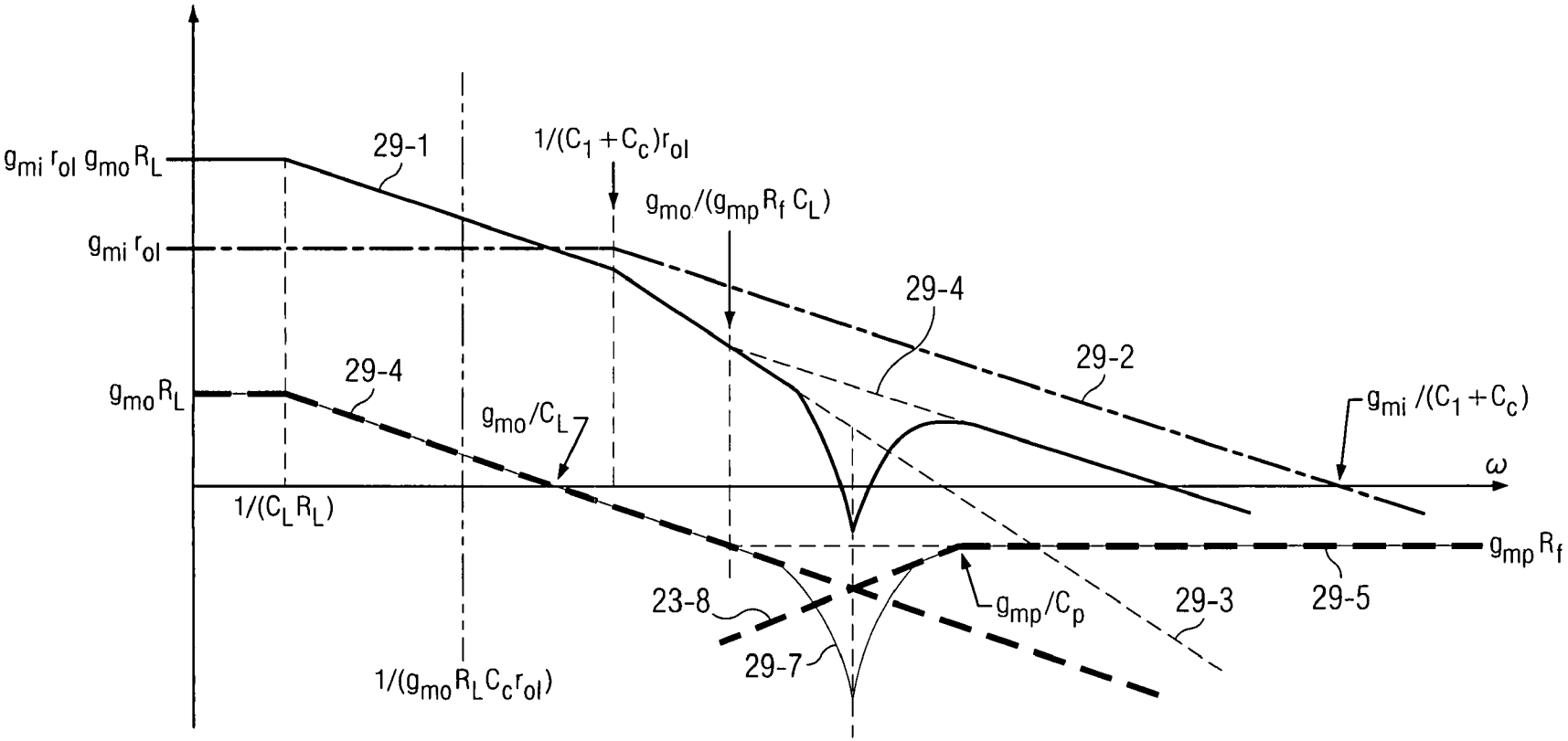

FIG. 8A shows a Bode plot for the case in which $C_p$ is large enough that corner frequency $g_{mp}/C_p$ is on the left hand side of frequency $g_{mo}/(g_{mp}R_fC_L)$. Curves 23-5 and 23-8 show the signal transfer function from gate 3 to node 4A by transistor $MP_{pa}$. At low frequencies, the effect of transconductance from the drain of transistor $MP_{pa}$ is $sC_p$. ("s" is equal to jω, wherein ω is the frequency in radians) and the voltage signal at node 4A due to transistor $MP_{pa}$ is $sC_pR_f$ (Curve 23-8). At high frequencies, the effect of transconductance from the drain of transistor $MP_{pa}$ is $g_{mp}$, and the voltage signal at node 4A due to transistor $MP_{pa}$ becomes $g_{mp}R_f$ (curve 23-5). A minimum value of $C_p$ is needed in that the corner frequency, $g_{mp}/C_p$ of curves 23-5 and 23-8 has to be lower than $$\frac{g_{mo}}{C_L} \times \frac{1}{g_{mp}R_f}$$

so that the signal from $MP_{pass}$, Curve 23-4, crosses the level portion of the signal from transistor $MP_{pa}$, Curve 23-5, in order to avoid a gain notch. It can be determined that $C_p$ has to be greater than $g_{mp}^2R_fC_1/g_{mo}$. FIG. 8B shows a Bode plot wherein $C_p$ is not large enough and the corner frequency $g_{mp}/C_p$ is on the right hand side of frequency $g_{mo}/(g_{mp}R_fC_L)$ causing a gain notch 29-7, leading to an inadequate compensation.

If a 1 nanoampere (nA) current flows through parallel signal path transistor $MP_{pa}$, $g_{mp}$=40 nanoamperes per volt. Without any external load, i.e., if $R_L$=infinity, the current loading transistor $MP_{pass}$ is from the $R_1/R_2$ divider, which conducts 50 nanoamperes, so $g_{mo}$=2 uA/V, and $C_p$ is found to be 400 nanofarads for $C_L$=100 μF, which is prohibitively large for a monolithic (i.e., on-chip) capacitor.

Figure 9A:
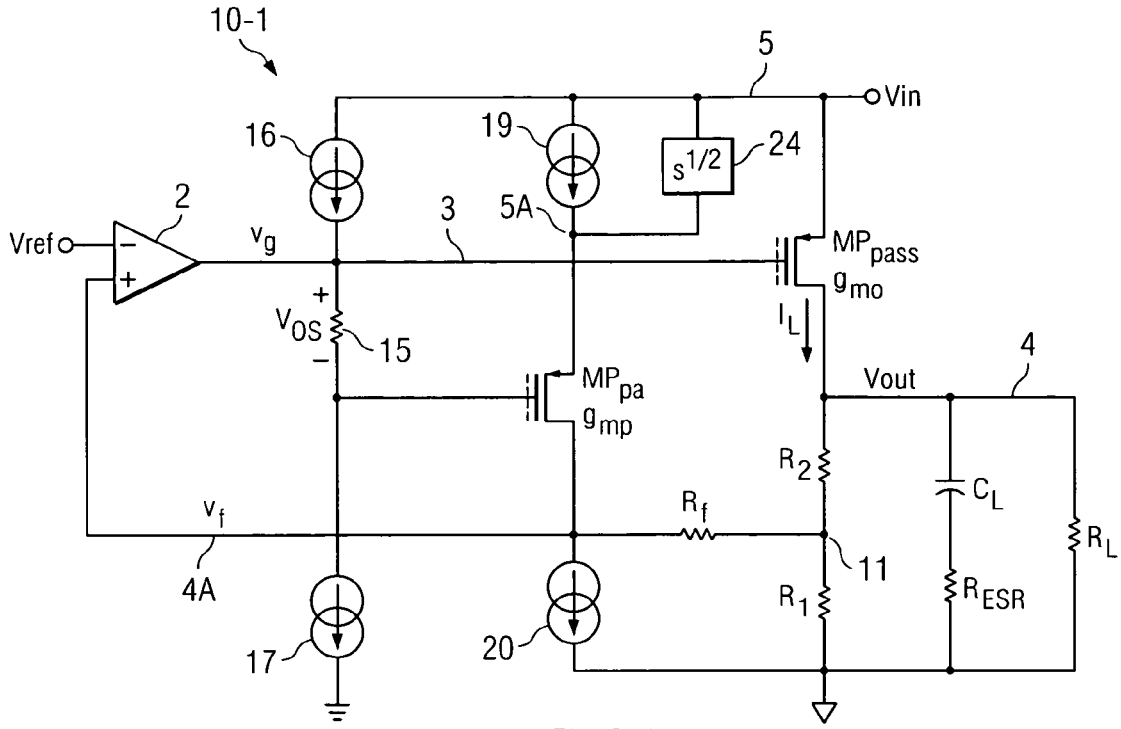
FIG. 9A is a schematic diagram of the low dropout voltage regular of FIG. 7C wherein $C_p$ is replaced with an $s^{1/2}$ frequency response network to avoid a gain notch in the Bode plot.

The gain notch stems from two signals (one signal being from the drain of transistor $MP_{pass}$ which has a 1/s frequency response due to $C_L$, and the other signal being from the drain of transistor $MP_{pa}$ which has s frequency response due to $C_p$), summing at conductor 4A and canceling each other. To resolve this issue, a fractional frequency response network 24 connected between Vin and conductor 5A as shown in FIG. 9A is used to replace $C_p$ of FIG. 7C. The idea is demonstrated by employing an $s^{1/2}$ frequency response network. With the $s^{1/2}$ frequency response network connected to its source, the frequency response at the drain of transistor $MP_{pa}$ becomes $s^{1/2}$ at low frequencies.

Figure 9B:
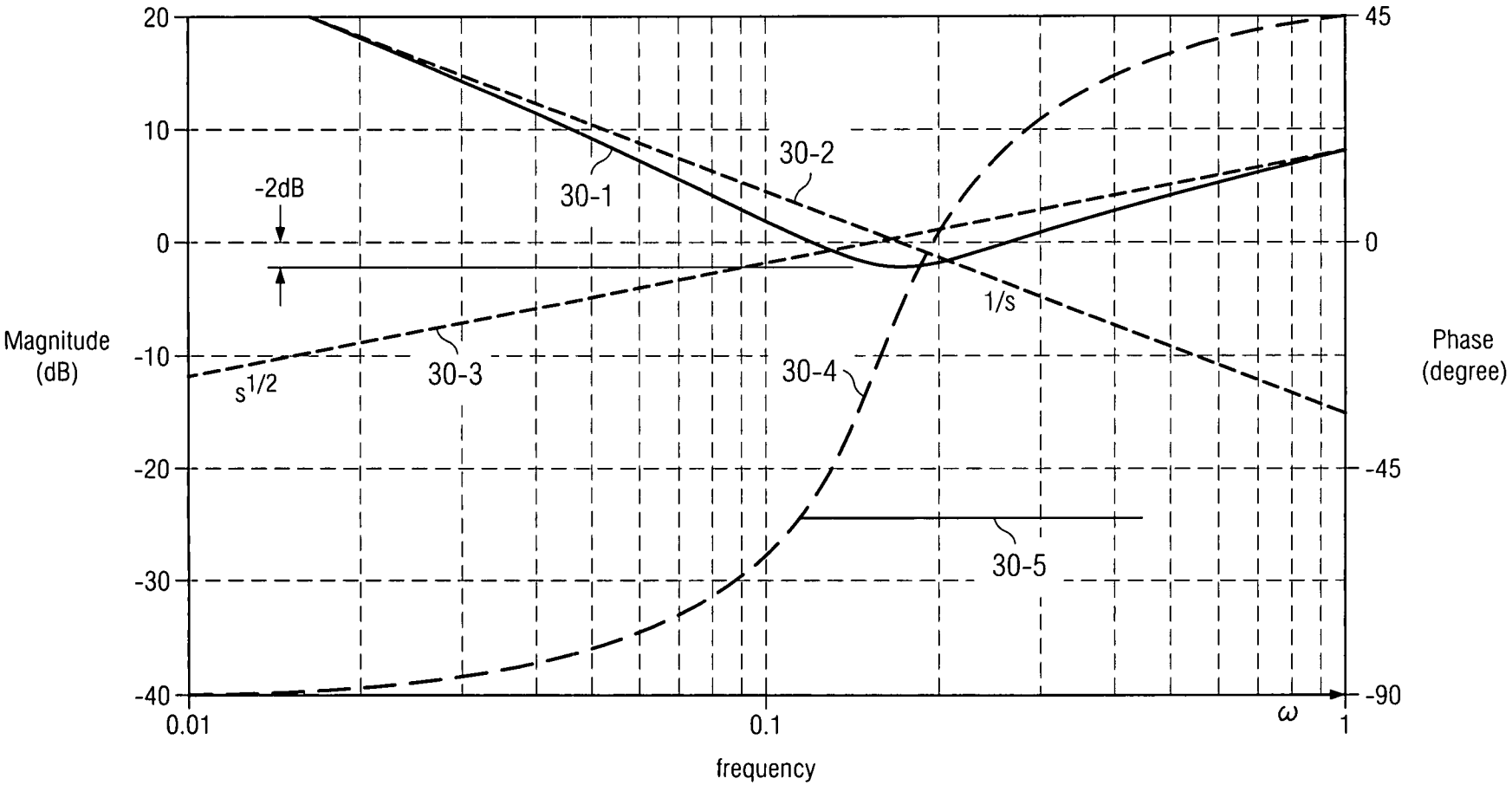
FIG. 9B is a graph which shows the magnitude and phase versus frequency for the sum of the two signals having 1/s and $s^{1/2}$ frequency responses, respectively.
Figure 9C:
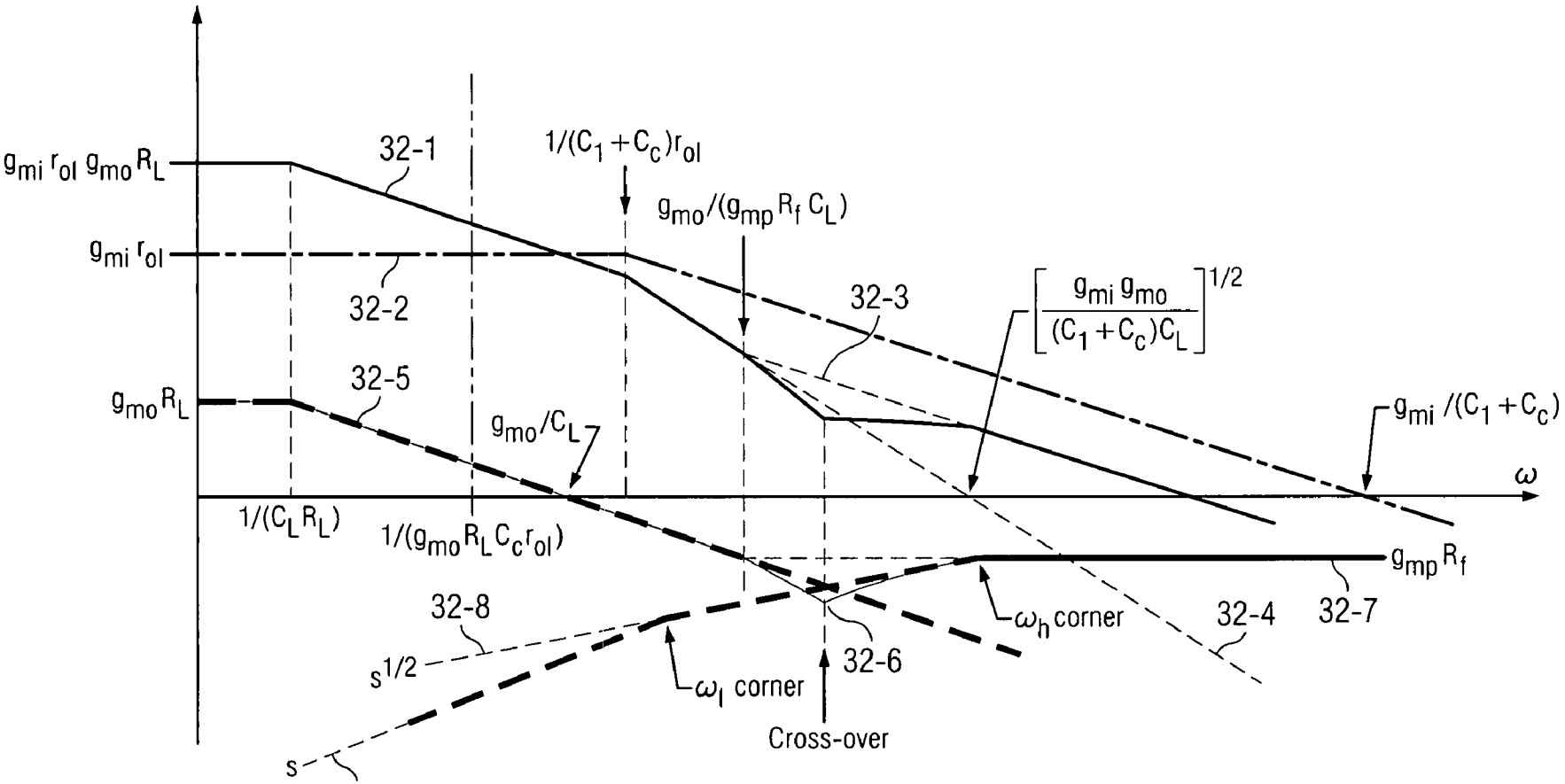
FIG. 9C is a Bode plot which illustrates the effect of removal of the gain notch in FIG. 7C by replacing $C_p$ with a $s^{1/2}$ frequency response network.

The magnitude (30-1) and phase (30-4) of the sum of the two signals with 1/s and $s^{1/2}$ frequency responses 30-2 and 30-3, from transistors $MP_{pass}$ and $MP_{pa}$, respectively, respectively, are shown in FIG. 9B. It can be seen that the magnitude of the sum represented by curve 30-1 troops only for 2 dB at the cross-over frequency. FIG. 9C is the Bode plot which shows that a significant gain notch is avoided by replacing $C_p$ with a $s^{/1/2}$ frequency response network. This implies that corner frequency $\omega_h$ can be placed at a fairly high frequency and the compensation network may be implemented using much smaller on-chip capacitors.

Figure 10A:
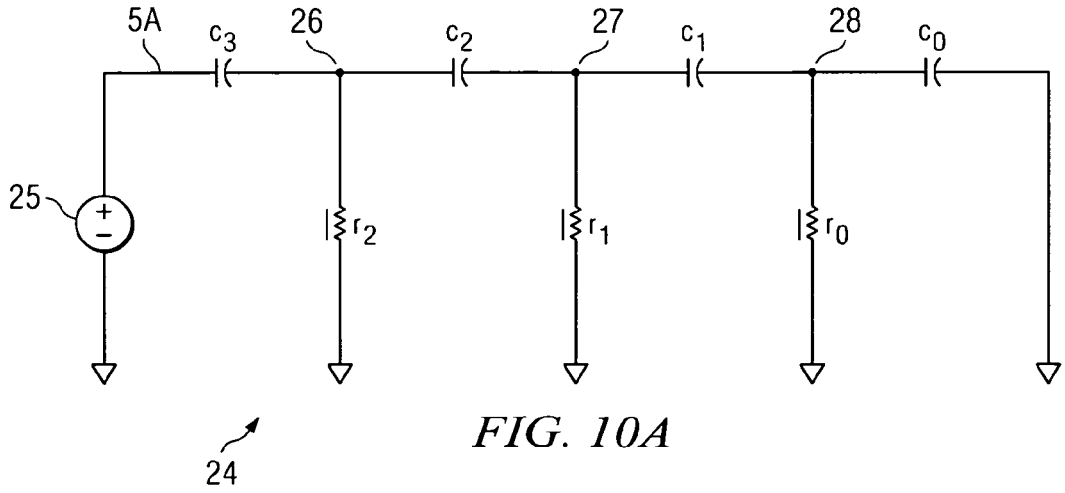
FIG. 10A is a schematic diagram of a RC network implementation of fractional frequency response network 24 in FIG. 9A.

The fractional frequency response network 24 of FIG. 9A can be implemented by the RC network shown in FIG. 10A. Network 24 includes a capacitor $c_3$ having one terminal connected to the (+) terminal of a voltage source 25, the (−) terminal of which is connected to ground. The other terminal of capacitor $c_3$ is connected by a conductor 26 to one terminal of a capacitor $c_2$ and to one terminal of a resistor $r_2$, the other terminal of which is connected to ground. The other terminal of capacitor $c_2$ is connected by conductor 27 to one terminal of a resistor $r_1$, the other terminal of which is connected to ground. Conductor 27 also is connected to one terminal of a capacitor $c_1$, the other terminal of which is connected by conductor 28 to one terminal of a resistor $r_o$, the other terminal of which is connected to ground. Conductor 28 also is connected to one terminal of a capacitor $c_0$, the other terminal of which is connected to ground. In network 24, $c_{k+1}=nc_k$, $r_{k+1}=mr_k$. (For example, $c_1=2\ c_0$. $c_2=4c_0$, etc.) Further information on fractional frequency response networks can be found in the technical article "Fractal System as Represented by Singularity Function", by A. Charef, H. H. Sun, Y. Y. Tsao, and B. Onaral, IEEE Transactions on Automatic Control, Vol. 37(9), pp. 1465-1470, September 1992.

Figure 10B:
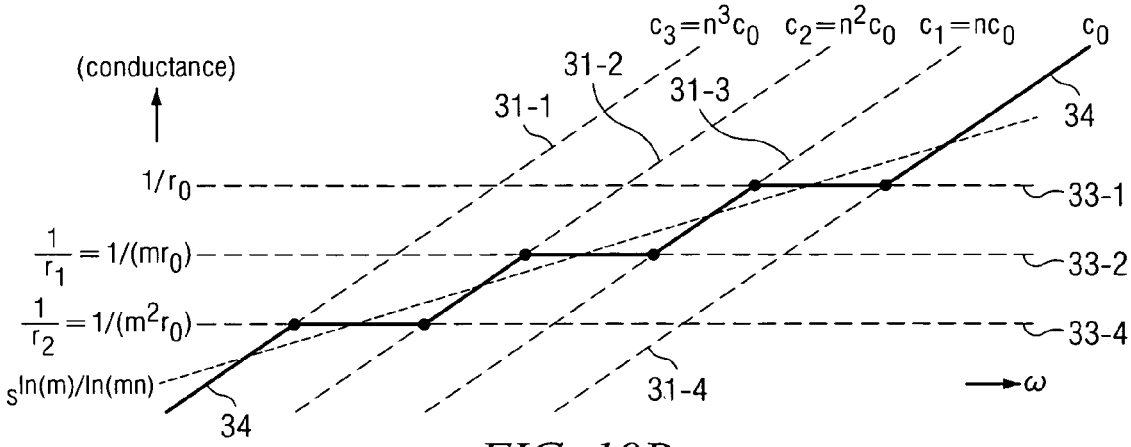
FIG. 10B is graph which shows a piece-wise linear representation of the conductance of the RC network shown in FIG. 10A.

To analyze the frequency responses of network 24, the conductance of each component is plotted on a logarithmic scale along dashed lines in FIG. 10B. The oblique lines 31-1, 2,3,4 represent the conductances for the capacitors which are parallel and evenly spaced. The horizontal lines 33-1,2,3 for the resistors also are parallel and evenly spaced. The oblique lines 33-1,2,3,4 for the capacitors intersect the horizontal lines 33-1,2,3. It is important to note that each of the capacitors $c_0$, $c_1$, $c_2$ and $c_3$ except the last capacitor $c_0$ is used as a series circuit element, and its AC conductance becomes more dominant when its value is smaller, whereas each of the resistors $r_o$, $r_1$ and $r_2$ is used as a shunt circuit element, and its conductance becomes more dominant when its value is larger. With that observation, the network can be analyzed. Starting from very high frequencies, the AC conductance values of capacitors $c_0$, $c_1$, $c_2$ and $c_3$ are much higher than those of resistors $r_o$, $r_1$ and $r_2$ and capacitor $c_0$ gains the dominance in the serial capacitor chain as if the resistors do not exist. The response of network 24 on conductor 5A follows the $c_0$ conductance line 31-4 down to lower conductance values as the frequency decreases until it intersects $r_0$ conductance line 33-1 and $r_0$ gains the dominance as $r_0$ has a higher shunt conductance. The response of network 24 then follows the $r_0$ conductance line to the next intersection point with the conductance line of $c_1$. From that point, it follows the $c_1$ conductance line further downward, and so forth.

Figure 10C:
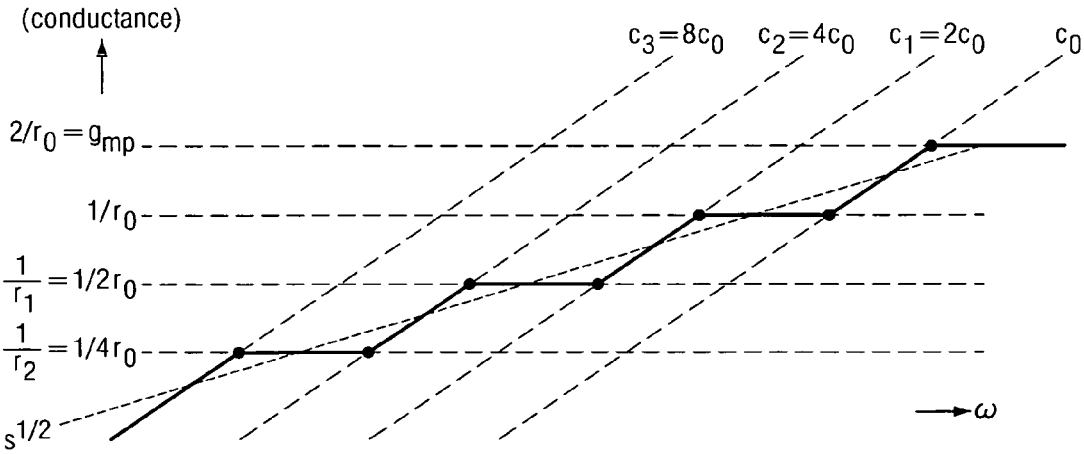
FIG. 10C is a graph which shows a piece-wise linear representation of the conductance of the RC network shown in FIG. 10A wherein m=n=2.

The response of network 24 follows the conductance lines of capacitors and resistors alternatively and repeatedly until it reaches the $c_3$ conductance line, and from there on, it stays on the $c_3$ conductance line. The foregoing response of network 24 is shown as a solid line 34 in FIG. 10B. It can be seen that the broken or piecewise-linear lines alternately following the conductance lines of capacitors and resistors, for frequencies spanning from $1/(c_0r_0)$ down to $1/[n(mn)kc_0r_0]$ (where k is the number of network stages, k=2 in this case), can be taken as an approximation to a fractional frequency response $s^a$ (a=ln(m)/ln(mn)<1, where ln is the natural logarithmic function), shown as a line 34 in FIG. 10B. The low frequency end corner, which is the cross-over between lines 31-1 and 33-4, can be extended further by adding more stages, at the expense of more capacitors and resistors. A better approximation to the fractional frequency response line can be achieved by using smaller values of m and n, at the expense of more stages and more total capacitances and resistances if the frequency span is kept the same. In one design, m=n=2, and a=ln(m)/ln(mn) =½ are used. FIG. 10C shows the conductance of the RC network shown in FIG. 10A, wherein m=n=2.

By replacing the $s^{1/2}$ function block in FIG. 9A with the RC network, and setting the value $r_0=1/(2\ g_{mp})$=12.5 megohms, the effective transconductance of the parallel signal path including transistor $MP_{pa}$ and resistors $R_f$, $R_1$ and $R_2$ is shown in FIG. 10C. The corner frequency $\omega_h$ is given by $g_{mp}/c_0$. Assuming that $g_{mi}$=530 nanoamperes per volt, $C_1$=78 pF, $C_c$=14 pF, $g_{mo}$=2 micromperes per volt, and $g_{mp}R_f$=0.2, it is found that $c_0$>2.5 pF is enough to compensate the loop for 1

μF<$C_1$<100 μF. A higher value, $c_0$=6.4 pF, is selected in order to provide some leeway in the design. The resistances of the RC network are implemented by means of MOS resistors, which otherwise would be too large to be used on an integrated circuit chip.

Figure 11:
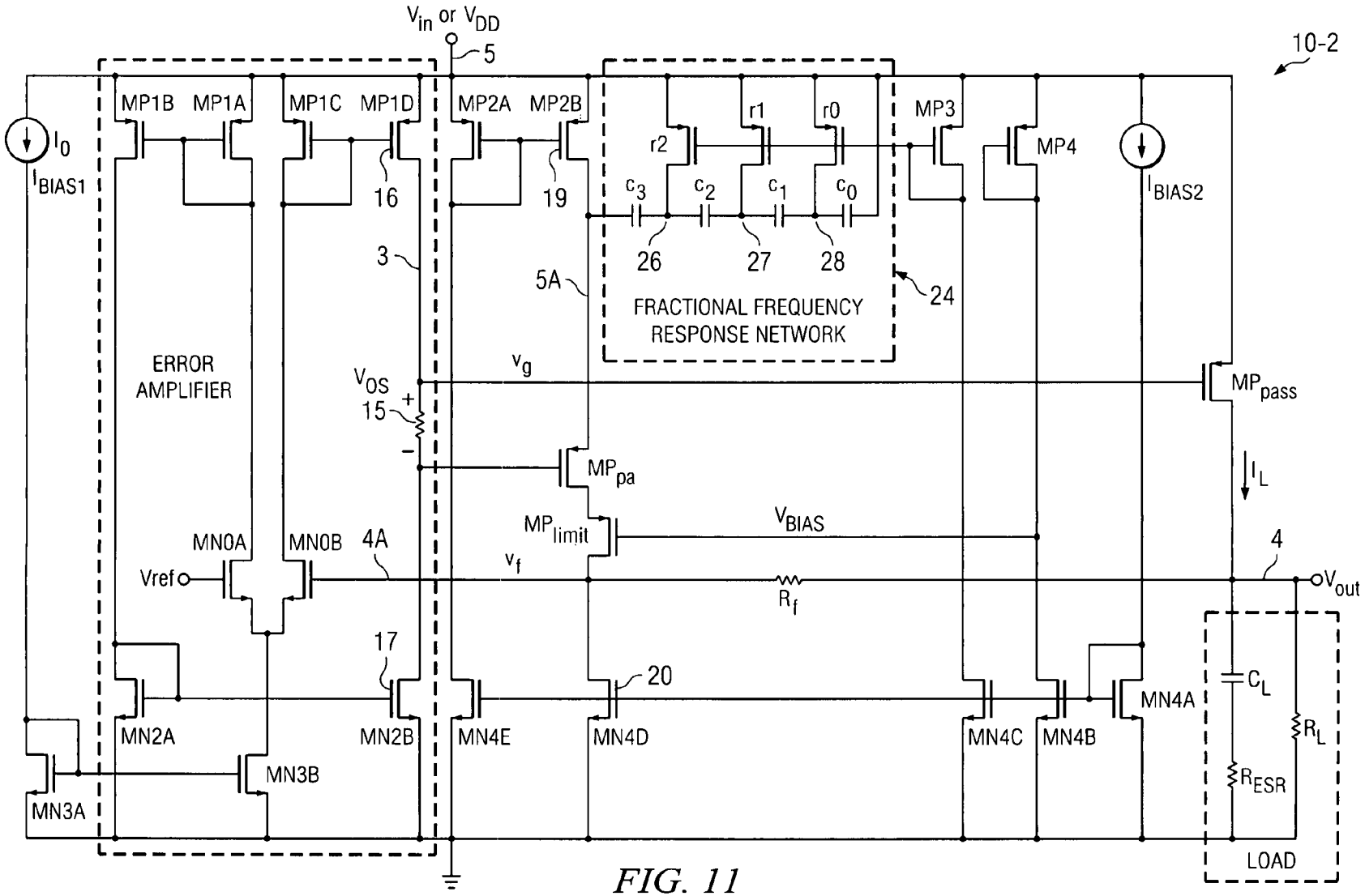
FIG. 11 is a detailed schematic diagram of a PMOS LDO with a parallel fractional frequency response signal path to provide loop compensation for a very light load condition.

FIG. 11 shows a schematic diagram of an LDO voltage regulator 10-2 similar to LDO voltage regulator 10-1 of FIG. 9A, including a parallel fractional frequency response signal path for loop compensation. Error amplifier 2 includes source-coupled N-channel input transistors MN0A and MN0B and a tail current source transistor MN3B, biased as shown by a current source $I_0$ and current mirror input transistor MN3A. The drain of input transistor MN0B is connected to a P-channel transistor MP1C which functions as a load device and also functions as a current mirror input transistor that controls a current mirror output transistor MP1D, the drain of which is connected by conductor 3 to drive the gate of pass transistor $MP_{pass}$ and one terminal of resistor 15 across which the offset voltage $V_{OS}$ is produced. Resistor 15 is set to a resistance of 1 megohm, which gives a $V_{OS}$ of 50 millivolts. The other terminal of resistor 15 is connected to the gate of parallel path transistor $MP_{pa}$ and the drain of a N-channel current mirror output transistor MN2B which functions as current source 17. The gate of transistor MN2B is controlled by N-channel current mirror input transistor MN2A, which receives a current that is mirrored from the drain of input transistor MN0A by means of P-channel transistors MP1A and MP1B. The gate of input transistor MN0A is coupled to Vref.

A P-channel current mirror output transistor MP2B, which functions as current source 19 in FIG. 9A, is controlled by a P-channel current mirror input transistor MP2A by means of a current source $I_{BIAS2}$ and N-channel current mirror transistors MN4A and MN4E. The drain of transistor MP2B is connected by conductor 5A to fractional frequency response network 24 and to the source of parallel path transistor $MP_{pa}$. Fractional frequency response network 24 includes capacitors $c_0$, $c_1$, $c_2$, and $c_3$ and resistors $r_0$, $r_1$, and $r_2$ as shown in FIG. 10A, with resistors $r_0$, $r_1$, and $r_2$ implemented by means of P-channel MOS resistors as illustrated. The gates of the MOS resistors are connected to the gate of a P-channel current mirror input transistor MP3 which is driven in response to the current source $I_{BIAS2}$ by means of N-channel current mirror transistors MN4A and MN4C.

The drain of parallel path transistor $MP_{pa}$ is connected to the source of a P-channel limit transistor $MP_{limit}$ the drain of which is connected by conductor 4A to the gate of input transistor MN0B, one terminal of feedback resistor $R_f$, and the drain of a N-channel current mirror output transistor MN4D which functions as current source 20 in FIG. 9A. The gates of transistors MN4B-E are connected to the gate of current mirror output transistor MN4A. The sources of N-channel transistors MN3A, MN3B, MN2A, MN2B, and MN4A-E are connected to ground, and the sources of P-channel transistors MP1A-D, MP2A, and MP2B and MOS resistors MP3 and MP4 are connected to Vin.

The parallel signal current from transistor $MP_{pa}$ drives the feedback node 4A through P-channel transistor $MP_{limit}$. There are two reasons that transistor $MP_{limit}$ is used. First, the parallel signal current through parallel path transistor $MP_{pa}$ is used mainly for loop compensation for very light loads. Transistor $MP_{limit}$ gradually "pushes" transistor $MP_{pa}$ into its linear operating region when the load current $I_L$ increases, and the parallel signal gradually diminishes to a negligible value as the load current $I_L$ increases. Second, for very low input voltage Vin or $V_{DD}$, the gate of pass transistor $MP_{pass}$ can be pulled so low for high load current $I_L$ that transistor $MP_{pa}$ may go into linear operation. After transistor $MP_{pa}$ enters linear operation, not only is the parallel signal path broken, but also the fractional RC network appears on feedback conductor 4A, which does not help improve the phase margin at all, and instead introduces further phase shift in the feedback signal, making stability problems even worse.

Figure 12:
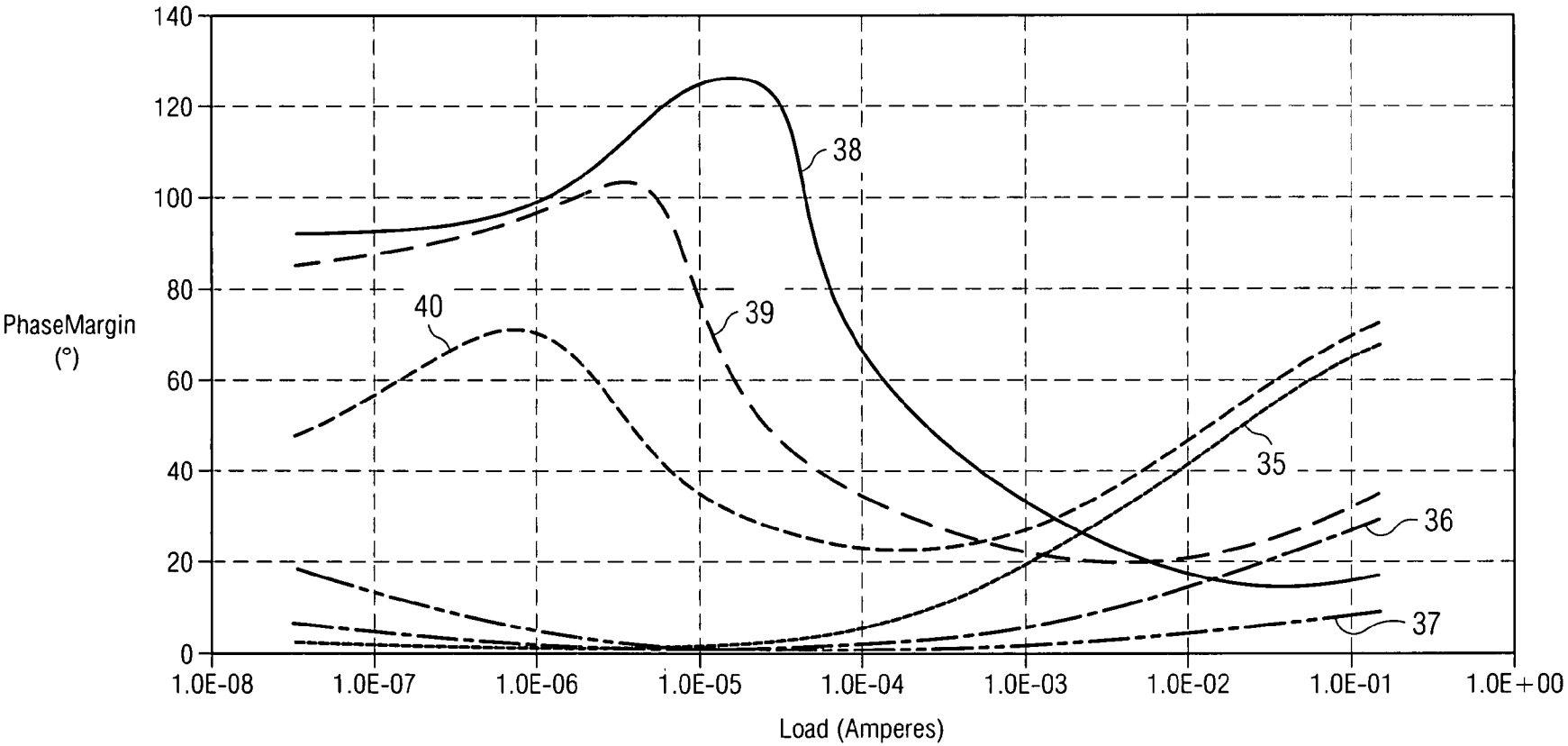
FIG. 12 is a graph showing phase margin versus load for the circuit of FIG. 11 with and without the parallel signal path.

The unity gain phase margins as a function of the load current for LDO voltage regulator 10-2 of FIG. 11 are shown as Curves 40, 39, and 38 in FIG. 12 for $C_L$=1 μF, 10 μF, and 100 μF, respectively. For comparison, the phase margins for the LDO regulator without the parallel signal path compensation are also shown as Curves 35, 36 and 37 for $C_L$=1 μF, 10 μF, and 100 μF, respectively. It can be seen that significant phase margin improvements are achieved under very light conditions. At high loads, the phase margins gradually approach the phase margins without the parallel path signal compensation, which manifests the parallel path signal current gradually diminishing due to transistor $MP_{limit}$ as mentioned above.

Figure 13A:
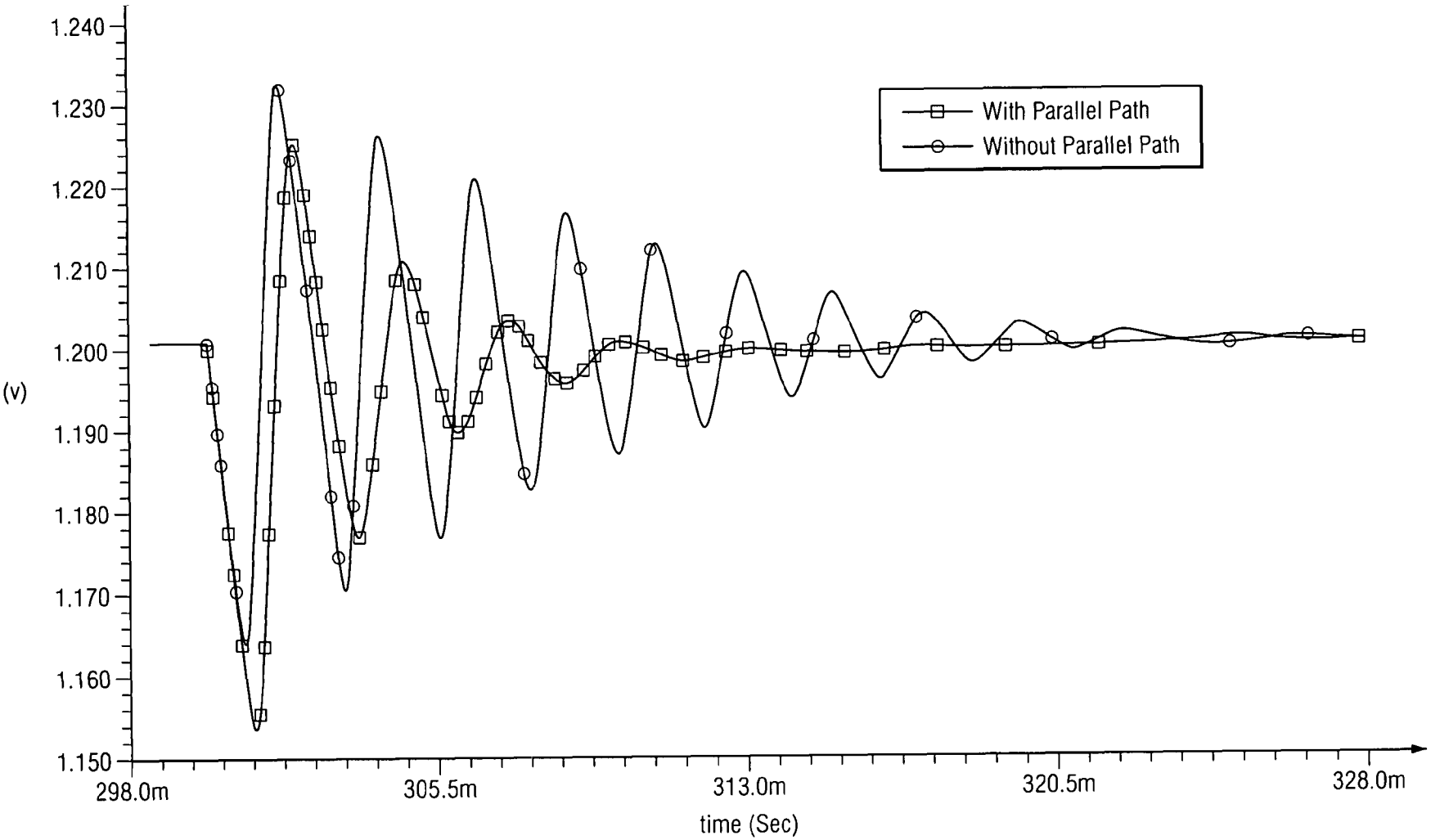
FIGS. 13A and 13B show simulated transient responses for low dropout regulators with and without parallel compensation paths, respectively.
Figure 13B:
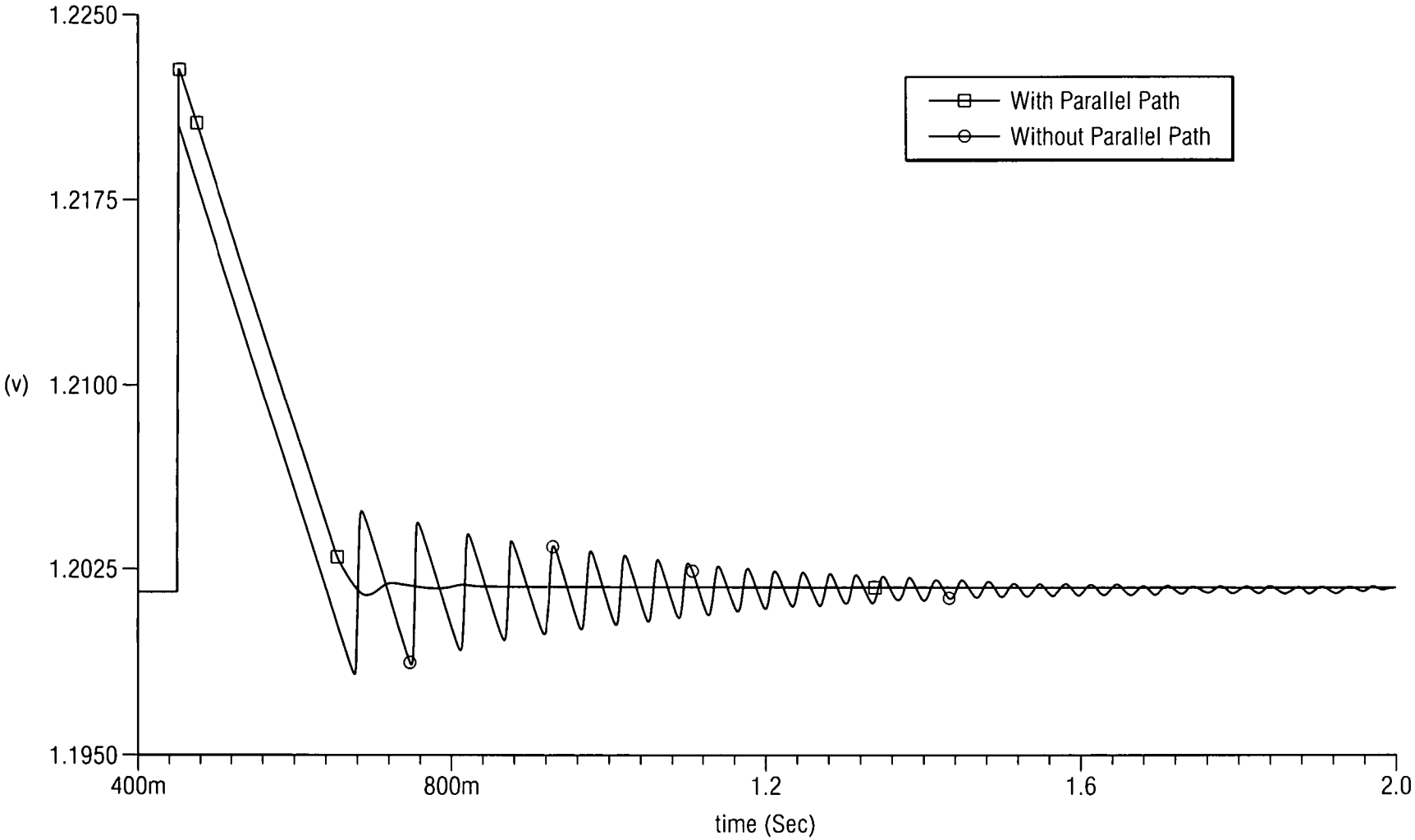

FIGS. 13A and 13B illustrate the output voltage load transient responses for voltage regulator 10-2 of FIG. 11 with the parallel signal path including transistor $MP_{pa}$ under the condition Vin=3.5 volts, voltage regulator gain G=1, $C_L$=100 μF, $R_{ESR}$=50 megohms, temperature T=25 degrees C. In FIG. 13A the load current goes from 10 uA to 5 mA in 1 microsecond. In FIG. 13B the load goes from 5 mA to 10 uA in 1 microsecond. For comparison, the load transient responses with the same condition for the voltage regulator without the parallel signal path compensation are also shown. Without the parallel compensation path, substantial "ringing" (FIG. 13A) is observed in output voltages, demonstrating a very low phase margin. With the parallel compensation path, however, the ringing magnitudes and recovery times are reduced significantly (FIG. 13B), especially under light load conditions. Thus, a great improvement in the performance of the LDO is achieved with the parallel signal current path of the present invention.

The described PMOS LDO voltage regulators use very little quiescent current, and provide stable operation for a wide range of output capacitor values from roughly 0.5 μF to 200 μF at the present state-of-the-art, both for active and resistive loads. The operation is relatively independent of the equivalent series resistance of the load capacitor $C_L$.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, although field effect transistors are used in the described embodiments of the invention, the invention also is applicable to embodiments in which bipolar (NPN and/or PNP) transistors are used.

What is claimed is:

1. A low drop out (LDO) voltage regulator comprising:

a pass transistor having a first electrode coupled by an output conductor to a load and a second electrode coupled to an input voltage;

an error amplifier having a first input coupled to a reference voltage, a second input connected to a feedback conductor, and an output coupled to a control electrode of the pass transistor;

a parallel path transistor having a first electrode coupled to the input voltage, a control electrode coupled to the output of the error amplifier, and a second electrode coupled to the feedback conductor, wherein the gate of the parallel path transistor is coupled to the output of the error amplifier by means of an offset voltage source; and a feedback resistance coupled between the feedback conductor and the output conductor.

2. The LDO voltage regulator of claim 1 wherein the pass transistor and the parallel path transistor are P-channel MOS transistors, and wherein the first electrodes are sources, the second electrodes are drains, and the control electrodes are gates.

3. The LDO voltage regulator of claim 1 wherein a channel-width-to-channel-length ratio of the parallel path transistor is substantially less than a channel-width-to-channel-length ratio of the pass transistor.

4. The LDO voltage regulator of claim 1 wherein the feedback resistance is a resistance of a feedback resistor is coupled directly between the feedback conductor and the output conductor.

5. The LDO voltage regulator of claim 1 wherein the feedback resistance is coupled to an intermediate conductor of a divider network coupled to the output conductor.

6. The LDO voltage regulator of claim 1 wherein the offset voltage source includes an offset resistor coupled between the gate of the pass transistor and the gate of the parallel path transistor, and also includes a first current source coupled to a first terminal of the offset resistor and a second current source coupled to a second terminal of the offset resistor.

7. The LDO voltage regulator of claim 6 including a third current source coupled between the input voltage and the source of the parallel path transistor, a fourth current source coupled to the drain of the parallel path transistor, and a capacitor coupled between the input voltage and the source of the parallel path transistor.

8. The LDO voltage regulator of claim 6 including a third current source coupled between the input voltage and the source of the parallel path transistor, a fourth current source coupled to the drain of the parallel path transistor, and a fractional frequency response network coupled between the input voltage and the source of the parallel path transistor.

9. The LDO voltage regulator of claim 8 wherein the fractional frequency response network includes first, second, and third MOS resistive elements each having a source coupled to the input voltage and a gate coupled to a first bias voltage, and first, second, third, and fourth capacitors, the first capacitor being coupled between the input voltage and a drain of the first MOS resistive element, the second capacitor being coupled between the drain of the first MOS resistive element and a drain of the second MOS resistive element, the third capacitor being coupled between the drain of the second MOS resistive element and a drain of the third MOS resistive element, the fourth capacitor being coupled between the drain of the third MOS resistive element and the source of the parallel path transistor.

10. The LDO voltage regulator of claim 9 including a current limit transistor having a source coupled to the drain of the parallel path transistor, a gate coupled to a second bias voltage, and a drain coupled to the feedback conductor.

11. The LDO voltage regulator of claim 10 wherein the error amplifier includes first and second input transistors having sources coupled to a tail current transistor, a gate of the first input transistor being coupled to the reference voltage, a gate of the second input transistor being coupled to the feedback conductor, a drain of the first input transistor being coupled to a drain and gate of a first load transistor and a gate of a first current mirror output transistor having a drain coupled to a drain and gate of a first current mirror input transistor and a gate of a second current mirror output transistor which functions as the second current source, a drain of the second input transistor being coupled to a drain and gate of a second load transistor and a gate of a third current mirror output transistor which functions as the first current source.

12. The LDO voltage regulator of claim 11 wherein the first and second input transistors, the first current mirror input transistor, and the second current mirror output transistor are N-channel transistors, and wherein the first and second load transistors and the first and third current mirror output transistors are P-channel transistors.

13. The LDO voltage regulator of claim 12 including a P-channel fourth current mirror output transistor coupled between the input voltage and the source of the parallel path transistor functioning as the third current source and having a gate coupled to a gate and drain of a P-channel second current mirror input transistor and a drain of a N-channel fifth current mirror output transistor having a gate coupled to a gate and drain of a N-channel third current mirror input transistor, a N-channel sixth current mirror output transistor and having a drain coupled to the feedback conductor and a gate coupled to the gate and drain of the third current mirror input transistor, a N-channel seventh current mirror output transistor having a gate coupled to the gate and drain of the third current mirror input transistor and a drain coupled to a gate and drain of a first diode-connected P-channel transistor and the gates of the first, second, and third MOS resistive elements, and a N-channel eighth current mirror output transistor having a drain coupled to the gate of the current limit transistor and a gate and drain of a second diode-connected P-channel transistor and a gate coupled to the gate and drain of the third current mirror input transistor, the third current mirror input transistor having its gate and drain coupled to a bias current source.

14. A method of operating a low drop out (LDO) voltage regulator with low quiescent current and at least a predetermined phase margin despite large variations in load current, the method comprising:

applying an input voltage to a first electrode of a pass transistor and coupling a second electrode of the pass transistor to an output conductor applying an output voltage to a load;

coupling a first input of an error amplifier to a reference voltage, and coupling an output of the error amplifier to a control electrode of the pass transistor;

coupling a feedback resistance between the output conductor and a second input of the error amplifier; and compensating the LDO voltage regulator by coupling a parallel path transistor between the input voltage and the second input of the error amplifier and by coupling a control electrode of the parallel path transistor to the output of the error amplifier, wherein an offset voltage is applied between the control electrode of the parallel path transistor and the output of the error amplifier.

15. The method of claim 14 wherein applying the offset voltage includes forcing a current through an offset resistor to generate the offset voltage and coupling a first current source between the input voltage and the first electrode of the parallel path transistor, coupling a fourth current source to the second electrode of the parallel path transistor, and coupling capacitive circuitry between the input voltage and the first electrode of the parallel path transistor.

16. The method of claim 15 providing the capacitive circuitry in the form of a fractional frequency response network coupled between the input voltage and the first electrode of the parallel path transistor.

17. The method of claim 15 including coupling a current limit transistor between the second electrode of the parallel path transistor and the second input of the error amplifier, and coupling a control electrode of the current limit transistor to a second bias voltage.

18. A low drop out (LDO) voltage regulator with low quiescent current and at least a predetermined phase margin despite large variations in load current, comprising:

a pass transistor and means for applying an input voltage to a first electrode of the pass transistor and means for coupling a second electrode of the pass transistor to apply an output voltage to a load;

means for coupling a first input of an error amplifier to a reference voltage and means for coupling an output of the error amplifier to a control electrode of the pass transistor;

means for coupling a feedback resistance between the output voltage and a second input of the error amplifier; and parallel path means coupled between the input voltage and the second input of the error amplifier for compensating a feedback loop of the LDO voltage regulator, the parallel path means comprising a second transistor having a gate thereof coupled to the output of the error amplifier via offset voltage means.

* * * * *